US006199458B1

(12) United States Patent
Wrigley et al.

(10) Patent No.: US 6,199,458 B1
(45) Date of Patent: Mar. 13, 2001

(54) LOCKING PLIERS

(75) Inventors: Harold K. Wrigley, Sewickley; Mark P. Noah, Butler; Adam R. Young, Chicora, all of PA (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/084,661

(22) Filed: May 26, 1998

Related U.S. Application Data

(60) Provisional application No. 60/047,688, filed on May 27, 1997.

(51) Int. Cl.[7] ..... B25B 7/14
(52) U.S. Cl. ..... 81/319
(58) Field of Search ..... 81/319, 367–383.5, 81/418, 424.5, 426, 426.5

(56) References Cited

U.S. PATENT DOCUMENTS

| | | | | |
|---|---|---|---|---|
| Re. 24,465 | | 4/1958 | Waterbury . | |
| 1,052,982 | * | 2/1913 | Sturtevant et al. | 81/319 |
| 2,475,866 | * | 7/1949 | Ward et al. | 81/319 |
| 2,521,276 | * | 9/1950 | Lampe | 81/372 |
| 2,532,659 | * | 12/1950 | Burns | 81/371 |
| 3,354,759 | * | 11/1967 | Cook | 81/379 |
| 3,496,808 | | 2/1970 | Schmidt . | |
| 3,657,948 | | 4/1972 | Myers . | |
| 4,407,493 | | 10/1983 | Okolischan . | |
| 4,499,797 | | 2/1985 | Wilson . | |
| 4,893,530 | * | 1/1990 | Warheit | 81/409.5 |
| 5,012,666 | * | 5/1991 | Chen et al. | 72/410 |
| 5,022,290 | | 6/1991 | Duffy . | |
| 5,056,385 | | 10/1991 | Petersen . | |
| 5,233,893 | * | 8/1993 | Schmidt | 81/368 |
| 5,351,585 | | 10/1994 | Leseberg et al. . | |
| 5,435,214 | | 7/1995 | Sisson . | |
| 5,609,080 | | 3/1997 | Flavigny . | |
| 5,842,371 | * | 12/1998 | Liaw | 72/409.12 |

FOREIGN PATENT DOCUMENTS

| | | | | |
|---|---|---|---|---|
| 475450 | * | 4/1951 | (CA) | 81/368 |
| 2451 -804 | * | 11/1980 | (FR) | 81/368 |

* cited by examiner

*Primary Examiner*—David A. Scherbel
*Assistant Examiner*—David B. Thomas
(74) *Attorney, Agent, or Firm*—Howrey, Simon, Arnold & White, LLP

(57) ABSTRACT

A pair of locking pliers includes a first assembly defining a first handle and a first jaw, a second handle, and a second jaw rotatably coupled to the first assembly and the second handle. The second handle is movable relative to the first handle to move the second jaw relative to the first jaw. An improved lock and release mechanism has a first setting wherein the second jaw is freely movable relative to the first jaw, a second setting wherein the second jaw locks at a preset distance from the first jaw when the second handle is moved toward the first handle, and a third setting wherein the second jaw unlocks when the second handle is moved toward the first handle.

26 Claims, 14 Drawing Sheets

42
50
47
46c
46a
44c
48
46b
44b
34a
40
44a 34a
48

48
34b 212
60
62b
64
62a
58

54
52b
36
52a

LOCKING PLIERS

CROSS-REFERENCE TO RELATED APPLICATION

This application claims the benefit of U.S. Provisional Application Ser. No. 60/047,688, entitled "Locking Pliers," filed May 27, 1997 by the same inventors, which is incorporated herein by reference in its entirety.

BACKGROUND OF THE INVENTION

1. Field of the Invention

The invention relates generally to locking pliers, and more particularly, to locking pliers having an improved locking and release mechanism.

2. Description of Related Art

Pliers having locking mechanisms to maintain the pliers jaws in a fixed position are well known. Such pliers typically include an adjustment mechanism that sets the pliers jaws at roughly a desired distance apart, and a toggle mechanism locks the pliers about a workpiece when the pliers handles are squeezed together. In known locking pliers, the action of squeezing the handles together drives the toggle mechanism beyond a "dead center point," to lock the jaws onto the workpiece.

Known locking pliers typically include a fixed handle and jaw with a movable jaw coupled thereto. The movable jaw is operated by a movable lever that has one end coupled to the movable jaw. The opposite end of the movable lever defines a movable handle. A link member connects the fixed handle to a forward section of the movable lever intermediate the movable handle and the movable jaw. The combination of the link member and the forward section of the movable lever constitute the toggle mechanism for locking and releasing the pliers. An adjustment mechanism, such as an adjustment screw, laterally moves the end of the link member connected to the fixed handle to adjust the separation of the fixed and movable jaws. A spring may be employed, for example, between the movable jaw and the fixed handle, to normally bias the jaws apart.

The above described arrangement of the link member and forward section of the movable lever define three pivot points around which the locking mechanism of typical prior art locking pliers operates. The first pivot point is the point at which the movable lever connects to the movable jaw. The second pivot point is located where the link member connects to the forward section of the movable lever, and the third pivot point occurs at the opposite end of the lever member, where the link member connects to the fixed handle.

When the locking pliers handles are apart (jaws apart, or open), the toggle mechanism (the forward section of the movable lever and the link member) forms an obtuse angle. As the handles are brought together, the jaws close towards each other, and the angle formed by the toggle mechanism approaches a straight line. The "dead center point" occurs when toggle member forms a straight line; in other words, when the three pivot points are in a line. As the handles continue to move together, the second pivot point passes the dead center point, and movement of the movable handle is halted, usually by the one or both of the forward section of the movable lever or the link member contacting a stop or the fixed handle. The jaws will maintain their closed position until the second pivot point is forced back across the dead center point by actuation of a release lever or other actuator provided on the fixed handle.

Unfortunately, there are several shortcomings associated with known locking pliers, such as those described above using a "dead center point" locking operation. First, the action of releasing the locked pliers jaws by pushing the middle pivot point back across the dead center point often requires two hands. The user has one hand gripping the handles of the pliers, and the user's other hand is required to activate the release. This two-hand requirement is simply unacceptable for many tasks requiring the use of a pair of pliers.

Further, the jaws of prior art locking pliers will lock any time the handles are manipulated such that the middle pivot point crosses the dead center point. Often, it is desirable to operate a locking pliers as a spring loaded pliers, for example, to achieve a "ratcheting" action when turning a nut or bolt. However, with known locking pliers, the jaws lock each time the handles are squeezed together, and the release mechanism must be actuated to unlock the pliers. This necessitates repeatedly locking and unlocking the pliers whenever repeated opening and closing of the jaws is required.

Moreover, the release lever of many prior art locking pliers may cause an uncontrolled or unintentional unlocking of the pliers. The release mechanisms of typical prior art locking pliers perform the unlocking function by pushing the center pivot point back across the dead center point. Once the center pivot point passes the dead center point from the locked position, the jaws are not maintained in their closed position. Further, since most known locking pliers are spring biased to an open position (jaws apart), as soon as the center pivot point passes the dead center point, the pliers will "spring" open. This can create several difficulties.

For example, if the locking pliers are being used in a clamping operation, the pliers will completely release if the release lever is inadvertently activated. During operations requiring locking and unlocking of the pliers, the user often does not have a free hand available to activate the release lever. Hence, the user may be required to release his grip from the handles, at least partially, to activate the release. If the user does not maintain control of the handles when the release is activated, the pliers may spring out of the user's hands, or possibly spring open and strike the user's hand.

Still further, many prior art locking pliers designs have a toggle mechanism including the link member described above, extending between the fixed handle and the movable lever. The combination of the handles and the link member produce various "pinch points." These pinch points are locations where material, such as a user's clothes or a finger, may be caught and pinched as the handles are moved relative to each other.

Thus, a need exists for locking pliers that address these, and other, shortcomings of the prior art.

SUMMARY OF THE INVENTION

In one aspect of the present invention, a pair of locking pliers includes a first assembly defining a first handle and a first jaw, and a second handle. A second jaw is rotatably coupled to the first assembly and the second handle, such that the second handle is movable relative to the first handle to move the second jaw relative to the first jaw. A locking mechanism interconnects the first assembly and the second handle. A release mechanism is rotatably coupled to the second handle. The release member interacts with the locking mechanism to fix the second jaw in a fixed position relative to the first jaw.

In another aspect of the present invention, a pair of locking pliers includes a first assembly defining a first handle and a first jaw, a second handle, and a second jaw rotatably coupled to the first assembly and the second handle. The second handle is movable relative to the first handle to move the second jaw relative to the first jaw. A release mechanism has a first setting wherein the second jaw is freely movable relative to the first jaw, a second setting wherein the second jaw locks at a preset distance from the first jaw when the second handle is moved toward the first handle, and a third setting wherein the second jaw unlocks when the second handle is moved toward the first handle.

BRIEF DESCRIPTION OF THE DRAWINGS

Other objects and advantages of the invention will become apparent upon reading the following detailed description and upon reference to the drawings in which.

Figure 1:
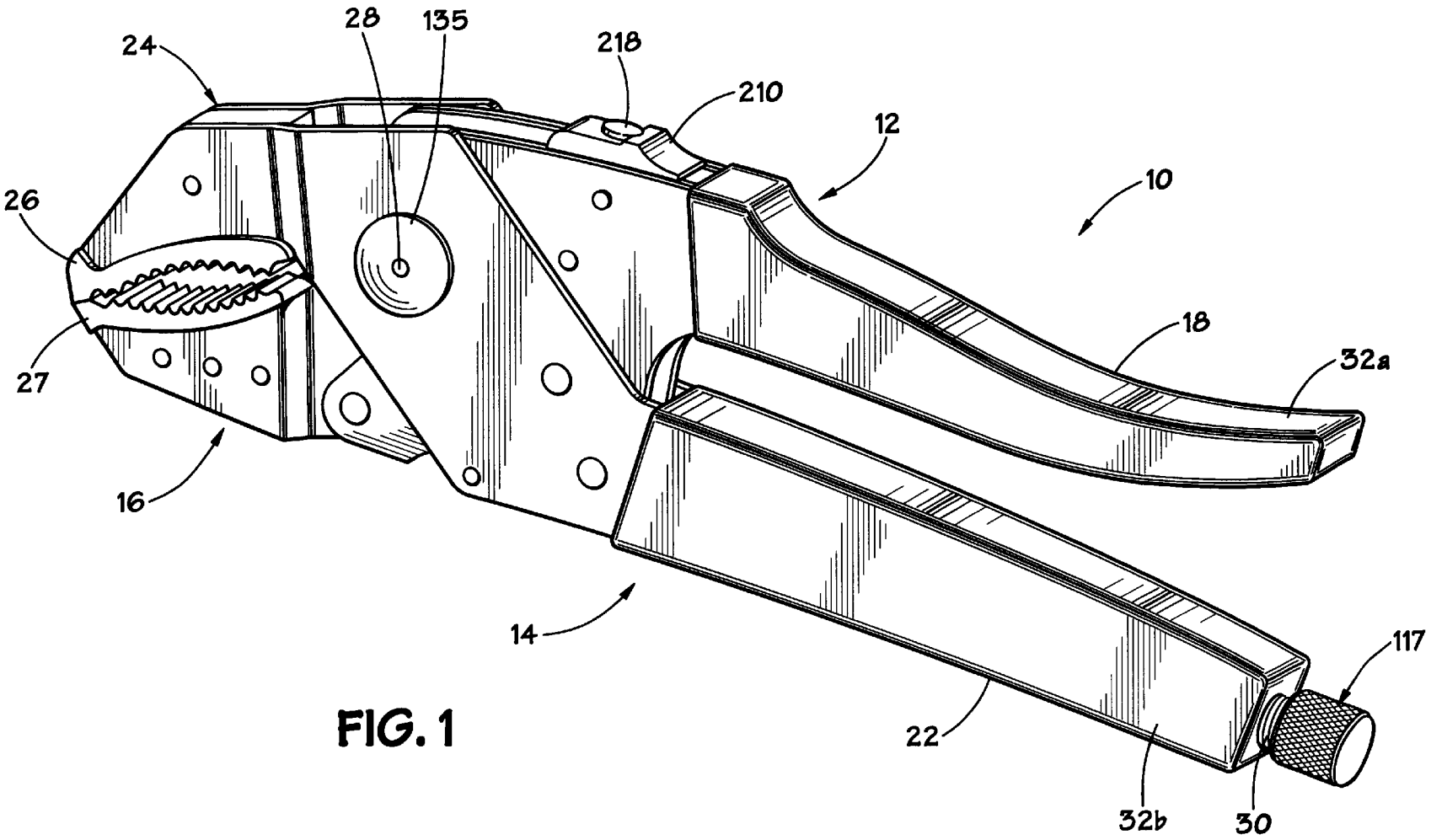
FIG. 1 is a perspective view illustrating an exemplary pair of locking pliers in accordance with an embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning to the drawings and, in particular, to FIG. 1, a perspective view of a pair of locking pliers 10 in accordance with an embodiment of the present invention is provided. In general, the pair of locking pliers 10 includes an upper handle assembly 12, a lower handle assembly 14, and a lower jaw assembly 16. The upper handle assembly 12 defines an upper handle 18 that extends from one end of the pliers 10. The upper handle assembly 12 is rotatably coupled to the lower jaw assembly 16 by a pin 20 (not visible in FIG. 1). An actuator 210 of a release mechanism 21 (not illustrated in FIG. 1) extends from the upper handle assembly 12.

The lower handle assembly 14 defines a lower handle 22 that extends in the same general direction as the upper handle 18. The lower handle assembly 14 also defines a head portion 24. An upper jaw member 26 is positioned within the head portion 24, and a lower jaw member 27 is positioned within lower jaw assembly 16. A pivot pin 28 passes through the lower handle assembly 14 and the lower jaw assembly 16, rotatably coupling the lower jaw assembly 16 to the lower handle assembly 14. The knurled end of an adjustment screw 30 extends from one end of the lower handle 22.

In the embodiment of FIG. 1, upper and lower grips 32*a* and 32*b*, formed of vinyl or other suitable material, are positioned about the upper and lower handles 18 and 22.

In operation, the user of the pair of locking pliers 10 may, through adjustment of the adjustment screw 30, preset the distance that will exist between the upper jaw member 26 and lower jaw member 27 in lower jaw assembly 16 when the pliers 10 are in their closed and locked position. Once the adjustment screw 30 is set, the pliers 10 may be placed in their closed and locked position by bringing the lower handle 22 towards the upper handle 18 (or vice versa) until the pliers 10 reach a locked and closed position. Once the pair of pliers 10 is placed in its closed and locked position, it may be released from that position through activation of the release actuator 210.

Figure 2:
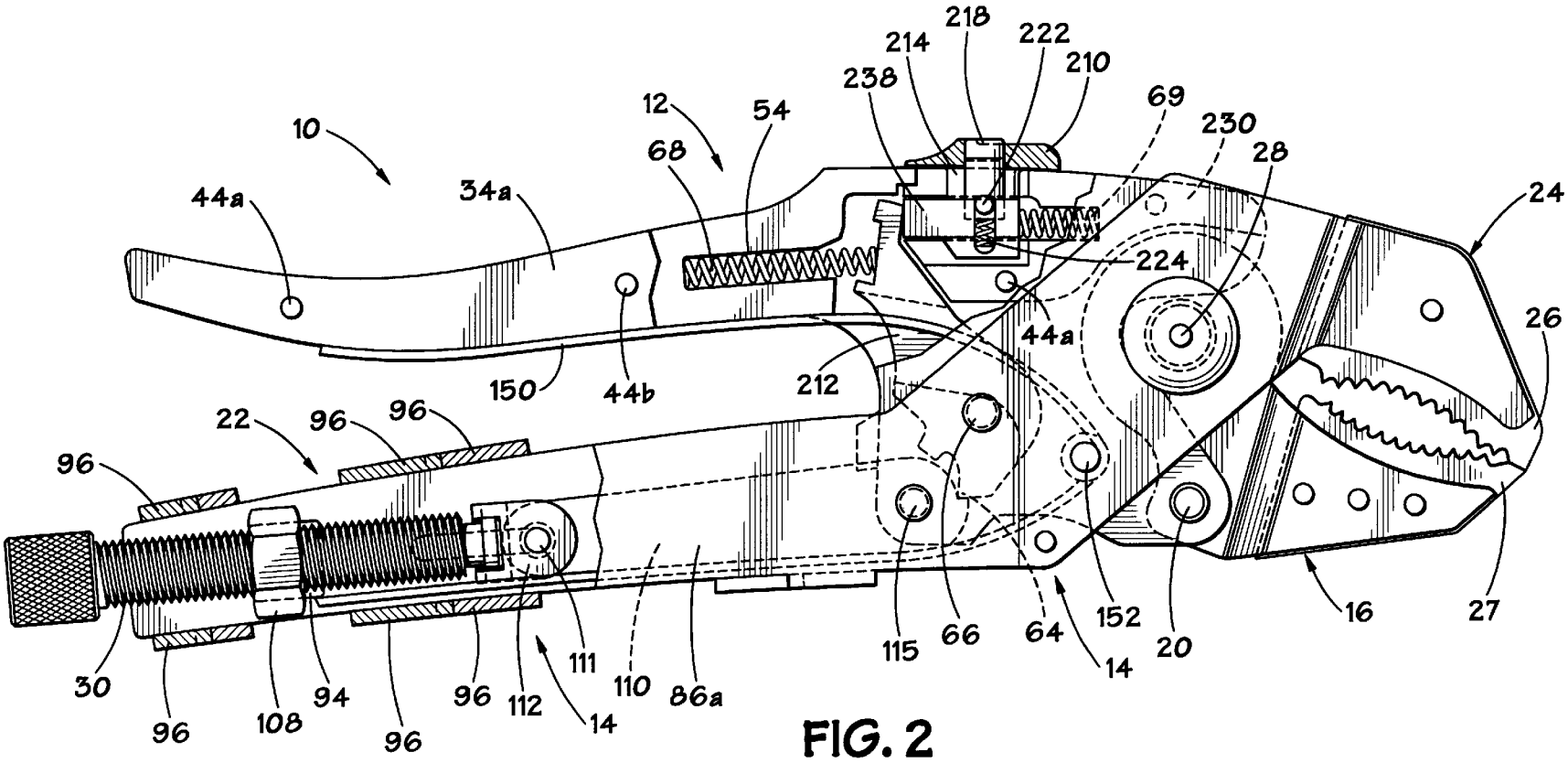
FIG. 2 is a side view of the exemplary pair of locking pliers illustrated in FIG. 1, illustrating several interior components in dashed lines.
Figures 3A, 3B, 3C, 4, 5:
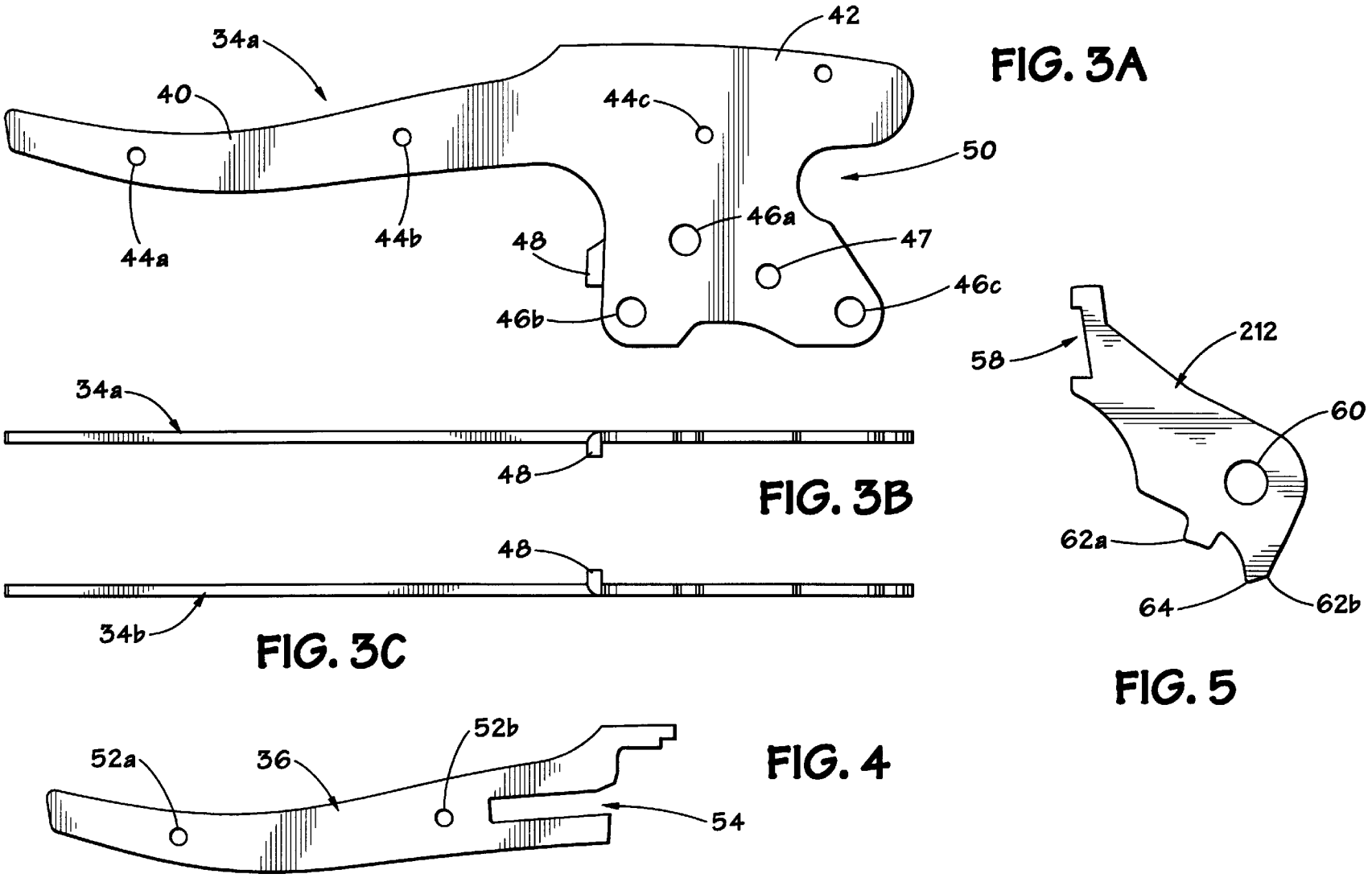
FIGS. 3A–3C illustrate a side view and bottom views of the main components of an upper handle assembly in accordance with an embodiment of the present invention.
FIG. 4 is a side view of an upper handle spacer in accordance with an embodiment of the present invention.
FIG. 5 is a side view of a pivot release member of a release mechanism in accordance with an embodiment of the present invention.

FIG. 2 shows a side view of the pliers 10 of FIG. 1, with many of the interior elements of the pliers 10 illustrated using dashed lines. The upper and lower grips 32*a*, 32*b* are not illustrated in FIG. 2. Referring to FIGS. 2 through 4, the upper handle assembly 12 comprises three major components: a right side upper handle portion 34*a* (looking down—the topmost upper handle portion in FIG. 2); a left side upper handle portion 34*b* (looking down—the bottom upper handle portion, not visible in FIG. 2); and an upper handle spacer 36 (not visible in FIG. 2). In general, the right and left side upper handle portions 34*a* and 34*b* and the upper handle spacer 36 are coupled together to form the upper handle 18 and an upper handle cavity within which is positioned the release mechanism 21.

In the embodiment of FIG. 2, both the right and left side upper handle portions 34*a* and 34*b* are constructed (blanked) from 1070 steel that has been cut through use of a progressive stamping die and has been heat treated and blackened via a black oxide coating. Other coatings, such as zinc chromate, would also be suitable. Still further embodiments using materials other than steel are envisioned. Both the right and left upper handle portions 34*a* and 34*b* may be constructed (blanked) from a piece of material of the form of the component designated 34 illustrated in FIG. 3A.

Referring FIG. 3A, the illustrated component 34 has a first extension that defines a handle portion 40 and a main body portion 42. Pin-receiving bores 44*a*, 44*b*, 44*c* are constructed (blanked and countersunk) in the handle portion 40 and three pin-receiving bores 46*a*, 46*b*, 46*c* are formed in the main body portion 42. The embodiment of the component 34 illustrated in FIG. 3A further defines a pin-receiving bore 47 that is smaller than the pin-receiving bores 46*a*, 46*b*, 46*c*. The main body portion 42 also defines an extension member 48 that extends from the main body portion 42 back towards the handle portion 40. The main body portion 42 further defines a cut-out section 50 that is generally opposite the extension member 48.

The right and left upper handle portions 34*a* and 34*b* that form the upper handle assembly 12 are generally identical with the exception of the handling of the extension member 48. To form the right side upper handle portion 34*a* the extension member 48 is bent in the direction illustrated in FIG. 3B by a pre-defined amount. In the illustrated example, the pre-defined amount is about 90 degrees. To form the left side upper handle portion 34*b*, the extension member 48 is bent in the direction opposite that illustrated in FIG. 3B. The bend used to form the left side upper handle portion 34*b* is generally illustrated in FIG. 3C. In the illustrated embodiment, the bend used to form the left side upper handle portion 34*b* is also about 90 degrees. In an alternative embodiment, the extension member 48 of both the right and left side upper handle portions 34*a*, 34*b* is bent about 30 degrees.

FIG. 4 provides an illustrative example of the upper handle spacer 36. In the illustrative example, the upper handle spacer 36 is formed of injection molded Delrin plastic. In general, the upper handle spacer 36 follows the general profile of the handle portions 40 of the right and left upper handle portions 34*a* and 34*b*. The upper handle spacer 36 defines two pin-receiving bores 52*a* and 52*b* that are arranged, constructed (blanked and countersunk), and sized in a manner similar to bores 44*a*, 44*b* of component 34. The upper handle spacer 36 also defines an elongated channel 54.

Referring back to FIG. 2, the release mechanism 21 will be discussed in greater detail. In general, the release mechanism 21 includes a pivot release member 212 that may be formed from 1070 heat-treated steel that has been appropriately cut through use of a stamping die. An exemplary pivot release member 212 is illustrated in FIG. 5. The steel used to form the pivot release member 212 may be blackened in a manner similar to that used to construct component 34, although in one embodiment no blackening is used such that the pivot release member 212 has an appearance different from that of the right and left upper handle portions 34*a* and 34*b*.

Because the pivot release member 212 experiences movement during the use of the pliers 10, it may be coated with an appropriate protective coating, such as 0.001 inch of zinc chromate. In general, the thickness of the material used to form the pivot release member 212 will be greater than that used to form the right and left upper handle portions 34*a* and 34*b*. For example, if steel having a thickness of 0.090 inches is used to form the right and left upper handle portions 34*a* and 34*b*, steel having a thickness of 0.170 inch may be used to form the pivot release member 212. A pin-receiving bore 60 passes through the pivot release member 212 and first and second extension surfaces 62*a* and 62*b* form a locking ledge 64. The pivot release member 212 further defines a slot 58.

Figure 6:
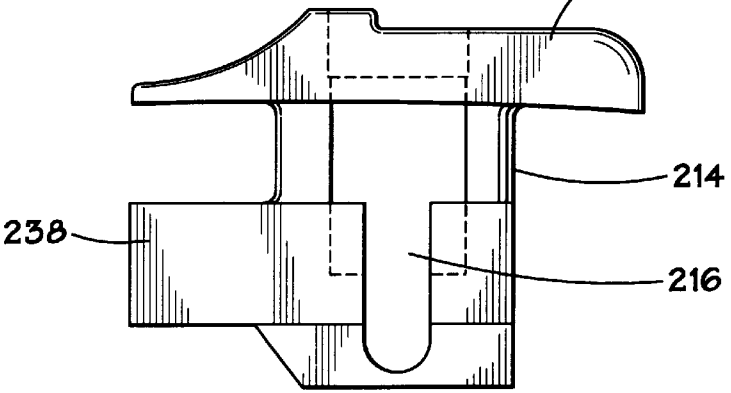
FIG. 6 is a side view of a release slide of a release mechanism in accordance with an embodiment of the present invention.
Figure 7:
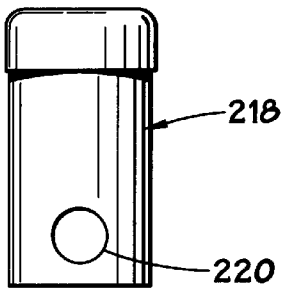
FIG. 7 is a side view of a release button of a release mechanism in accordance with an embodiment of the present invention.

The release mechanism 21 further includes a release slide 214. An embodiment of the release slide 214 is illustrated in FIG. 6. The release slide 214 includes an actuator portion 210, which, as illustrated in FIG. 1 and FIG. 2, protrudes above the upper handle assembly 12. The release slide 214 further defines a cavity 216 that is adapted to receive a release button 218. An embodiment of the release button 218 is illustrated in FIG. 7. The embodiment of the release button 218 defines a bore 220 extending therethrough, generally transverse to the main axis of the release button 218. A release pin 222 is seated in the bore 220, such that a portion of the release pin 222 extends from either side of the release button 218. A release spring 224 is received within the cavity 216, and the release button 218, with the release pin 222 seated in the bore 220, is also situated within the cavity 216 such that the release spring 224 biases the release button 218 in an upwards direction.

Figure 8:
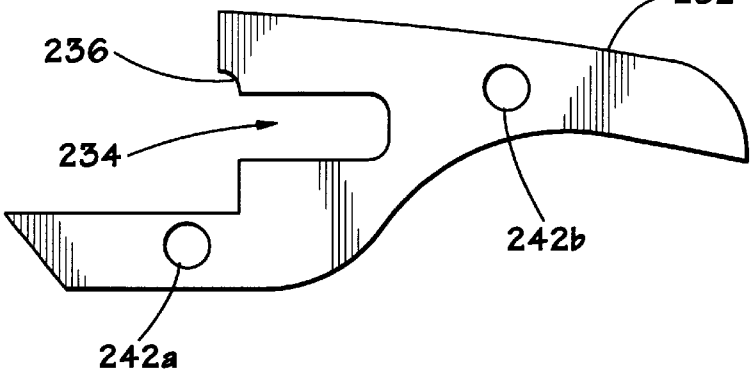
FIG. 8 is a side view of a middle release spacer of a release mechanism in accordance with an embodiment of the present invention.
Figure 9:
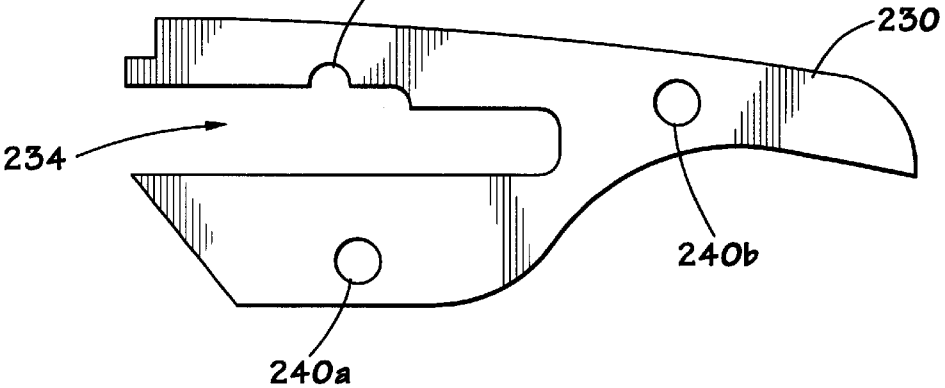
FIG. 9 is a side view of an outer release spacer of a release mechanism in accordance with an embodiment of the present invention.

First and second outer release spacers 230 are situated between the right and left upper handle portions 34*a* and 34*b* in the upper handle assembly cavity, and a middle release spacer 232 is sandwiched between the first and second outer release spacers 230. The first and second outer release spacers 230 are identical in shape, and are illustrated in FIG. 8. The middle release spacer 232 is illustrated in FIG. 9. The outer release spacers 230, and the middle release spacer 232 each define a channel 234 therein and a notch 236 that is adapted to receive the portions of the release pin 222 extending from either side of the release button 218. Each of the outer release spacers 230 defines two pin receiving bores 240*a*, 240*b* extending therethrough, and the middle release spacer 232 defines two corresponding pin-receiving bores 242*a*, 242*b*.

The manner in which the right and left upper handle portions 34*a* and 34*b*, the upper handle spacer 36, and the release mechanism 21 are coupled together to form the upper handle assembly 12 is generally illustrated in FIG. 2. Referring to FIG. 2, the upper handle assembly 12 may be formed by sandwiching the upper handle spacer 36, the pivot release member 212, and the remaining components of the release mechanism 21 between the right and left upper handle portions 34*a*, 34*b*, with the actuator 210 of the release mechanism 21 extending from the right and left upper handle portions 34*a*, 34*b*.

Figure 11:
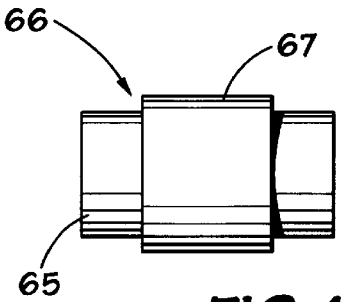
FIG. 11 is a side view of a rotation pin in accordance with an embodiment of the present invention.

A rotation pin 66, which passes through the bore 60 of the pivot release member 212 and bores 46*a* of the right and left upper handle portions 34*a*, 34*b*, serves to keep the pivot release member 212 in proper alignment with respect to the right and left upper handle portions 34*a* and 34*b*. One suitable rotation pin 66 is illustrated in FIG. 11. In general, the rotation pin 66 has an intermediate portion 67 of a first diameter and two projecting portions 65 of a lesser diameter. The projecting portions 68 are sized to be received by the corresponding bores 46*a* in the right and left upper handle portions 34*a* and 34*b*. The rotation pin 66 may be of standard construction and may be formed from either hot or cold rolled steel. In one embodiment, the rotation pin 66 is not fully hardened, but is only toughened to approximately 44–48 on the Rockwell C scale.

The upper handle assembly 12 may be held together by three upper handle rivet pins 67*a*, 67*b*, 67*c* that are positioned through the pin-receiving bores 44*a*, 44*b*, 44*c* of the right and left upper handle portions 34*a* and 34*b*, the pin-receiving bores 52*a*, 52*b* of upper handle spacer 36, the pin-receiving bores 240*a* of the outer release spacers 230, and the pin-receiving bore 242*a* of the middle release spacer 232. Additionally, a pin 67*d* extends through the pin receiving bores 240*b* of the outer release spacers 230 and the pin-receiving bore 242*b* of the middle release spacer 232, further keeping the middle release spacer 232 properly sandwiched between the outer release spacers 230. The use of pins 67*a*–67*d* is exemplary only; other suitable fasteners may be employed.

In the illustrative embodiment of FIG. 2, the channel 54 defined by the upper handle spacer 36, together with the right and left upper handle portions 36*a*, 36*b*, form a cavity within which a pivot release spring 68 is situated. The pivot release spring 68 functions to bias the pivot release member 212 towards the head portion 24 of the upper handle assembly 12, and against the lower portion 238 of the release slide 214. The right and left upper handle portions 34*a*, 34*b*, along with the channel 234 defined by the outer and middle release spacers 230, 232 forms another cavity within which a release slide spring 69 is situated, pushing the pivot release member 212 opposite the pivot release spring 68.

Figure 10:
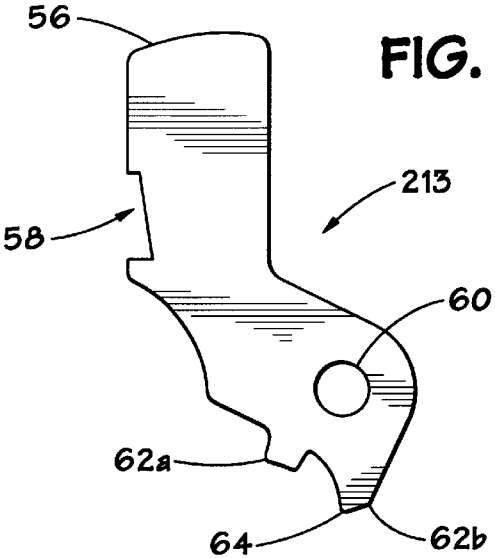
FIG. 10 is a side view of a pivot release member in accordance with an alternate embodiment of the present invention.

An alternative embodiment of the release mechanism is illustrated in FIG. 10. In the illustrated embodiment, the release mechanism generally comprises a single pivot release member 213, that may be formed in a manner similar to the pivot release member 213 of the release mechanism 21 disclosed herein in conjunction with FIGS. 5–9. An upper extension surface 56 of the pivot release member 213 protrudes from the upper handle assembly 12. This upper extension surface 56 may be depressed by the user of pliers 10 to disengage the pair of pliers from its closed and locked position. Because the human user of the pliers 10 will apply pressure to the pivot release member 213 to release the pliers 10 from their closed and locked position, the pivot release member 213 may be tumbled to smooth its surface. The lower portion of the pivot release member 213 is formed in a manner similar to the pivot release member 212 of the embodiment illustrated in FIG. 5. The operation of the release mechanism 21 is described further herein below.

Figure 12:
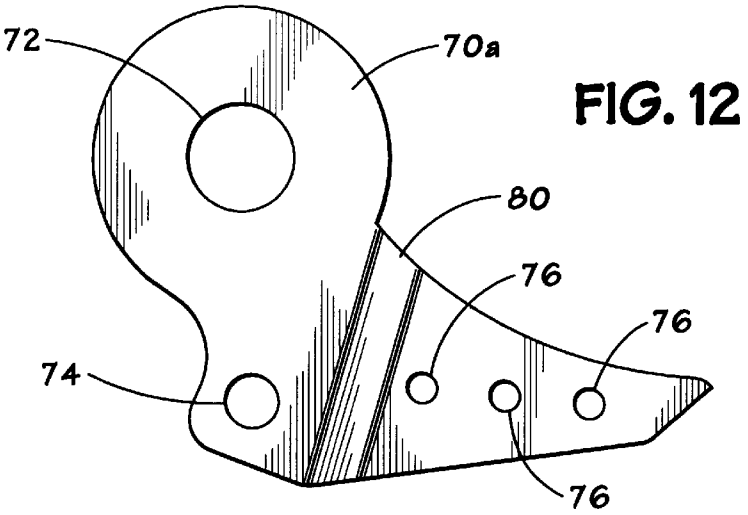
FIG. 12 is a side view of a lower jaw support in accordance with an embodiment of the present invention.

As illustrated in FIG. 2, the upper handle assembly 12 is coupled to the lower jaw assembly 16 by a pin 20. The pin 20 may be formed in a manner similar to the rotation pin 66 illustrated in FIG. 11. FIGS. 12–15 illustrate the lower jaw assembly 16 in greater detail. In general, the lower jaw assembly 16 is formed from two substantially-identical components 70*a* and 70*b* and a lower jaw member 27. FIG. 12 provides an illustrative example of the component 70*a*. In general, the component 70*a* may be formed of hardened, blackened 1070 steel. The component 70*a* defines a large bore 72 for receiving the pivot pin 28, and a first small bore 74 sized to receive the pin 20 for coupling the lower jaw assembly 16 to the upper handle assembly 12. Component 70*a* also defines one or more small bores 76. In the embodiment illustrated, there are three small bores 76. The component 70*a* is bent-out at region 80 in a manner illustrated more clearly in FIG. 13. Component 70*b* is substantially identical to component 70*a*, except that the bend at region 80 in component 70*b* is opposite to that of component 70*a*.

Figure 13:
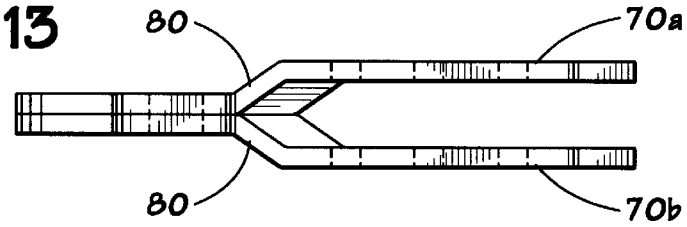
FIG. 13 is a bottom view of right and left side lower jaw supports as assembled in an embodiment of the present invention.
Figure 14:
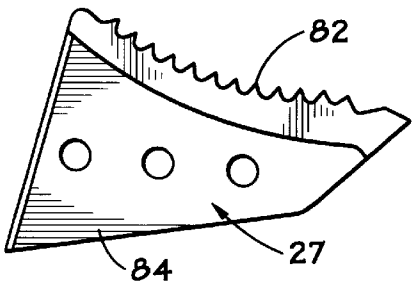
FIG. 14 is a side view of a lower jaw component in accordance with an embodiment of the present invention.

Components 70*a* and 70*b* may be brought together to form a lower jaw cradle in the manner illustrated in FIG. 13. The lower jaw member 27, which is illustrated in FIG. 14, may be placed in the lower jaw cradle to form the lower jaw assembly 16. As illustrated in FIG. 14, the lower jaw member 27 defines a toothed jaw surface 82 and a lower extension surface 84. In one embodiment the lower jaw element 27 is formed of powdered metal that has been formed in an appropriate mold and that has been manufactured to have a hardness of approximately 52 on the Rockwell C scale. Alternatively, the lower jaw member 27 may be of a laminated construction of similar material as the components 70*a* and 70*b* of the lower jaw assembly 16.

In the illustrated embodiment, the width of the toothed jaw surface 82 is greater than the width "d" of the lower jaw cradle and the width of the lower extension surface 84 is less than the width "d" of the lower jaw cradle (illustrated in FIG. 13). As such, the lower jaw element 27 may be placed in the lower jaw cradle such that the components 70*a* and 70*b* support the toothed jaw surface 82 of the lower jaw element 27. Rivet pins 85 may be positioned through the bores 76 in components 70*a* and 70*b* and corresponding bores 77 in the lower jaw element 27. The rivet pins 85 may be of a standard construction, 1008 SAIP.

Referring to FIG. 2 and FIGS. 15–18, an embodiment of the lower handle assembly 14 will next be described. In general, the lower handle assembly 14 is formed from a right side lower handle portion 86*a* (looking down—the topmost lower handle portion in FIG. 2) and a left side lower handle portion 86*b* (looking down—the bottom lower handle portion, not shown in FIG. 2). The right and left side lower handle portions 86*a* and 86*b* are coupled together and define a cavity therebetween. As discussed in more detail below, an adjustment mechanism, comprising the adjustment screw 30, an adjustment nut 108, and a connecting arm 110, is positioned within the cavity defined by the lower handle assembly 14.

Figure 15A:
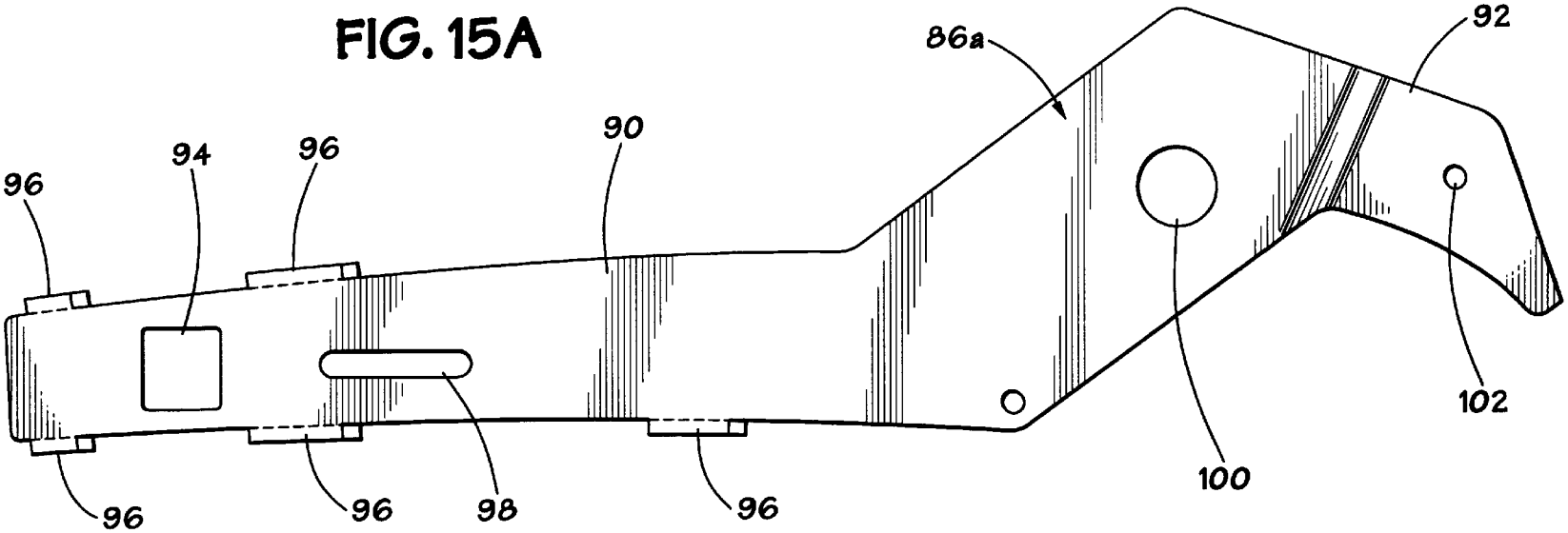
FIGS. 15A and 15B are side and bottom views of a right side lower handle in accordance with an embodiment of the present invention.
Figure 15B:
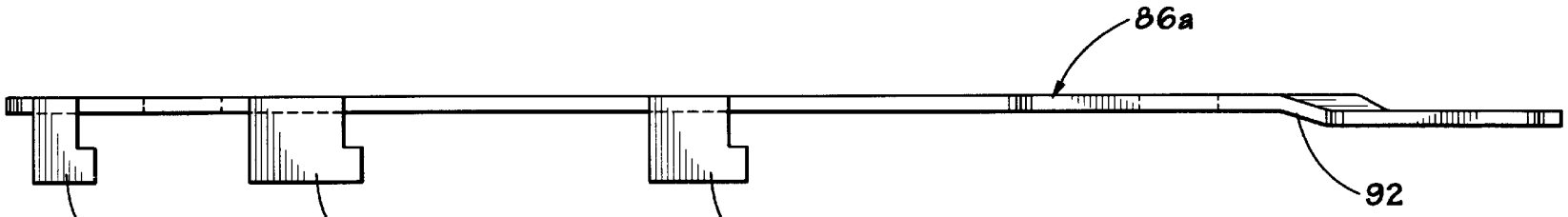
Figure 16A:
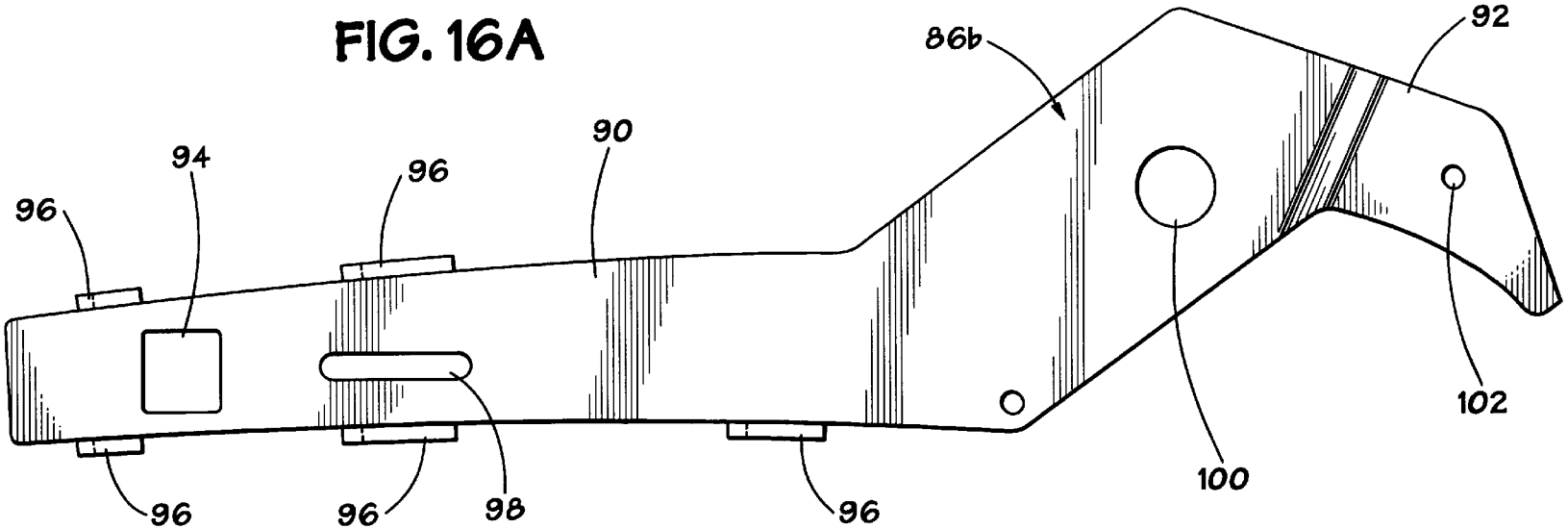
FIGS. 16A and 16B are side and bottom views of a left side lower handle in accordance with an embodiment of the present invention.
Figure 16B:
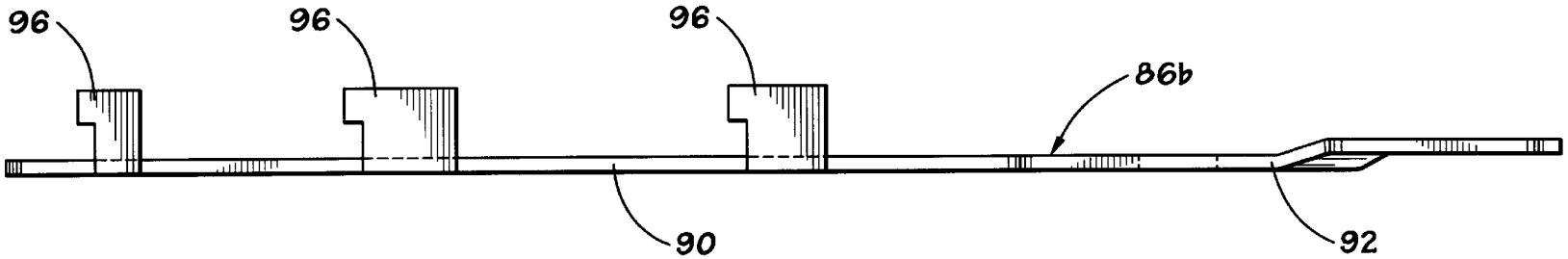

The right and left lower handle portions 86*a*, 86*b* may be formed from the same materials of and in the same manner of the right and left upper handle portions 34*a*, 34*b*. Unlike the right and left upper handle portions 34*a*, 34*b*, however, the right and left lower handle portions 86*a*, 86*b* are not identical. FIGS. 15A and 16A show side views of the right and left side lower handle portion 86*a*, 86*b*, respectively. The right and left side lower handle portions 86*a*, 86*b* each define a handle portion 90 and an offset head portion 92. The handle portions 90 each define a nut-receiving slot 94. In the embodiment illustrated, the nut receiving slot 94 of the lower left side handle portion 86*b* has a width that is less than the corresponding width of the nut-receiving slot 94 of the right side lower handle portion 86*a*. Located proximate to the nut-receiving slots 94 are a plurality of downwardly extending, generally L-shaped locking tabs 96. Each of the right and left side lower handle portions 86*a*, 86*b* define a pin receiving slot 98 formed at a position adjacent the nut-receiving slot 94. Two bores 100, 102 are formed in the offset head portion 92 of the right side lower handle portions 86*a*, 86*b*.

Figure 17:
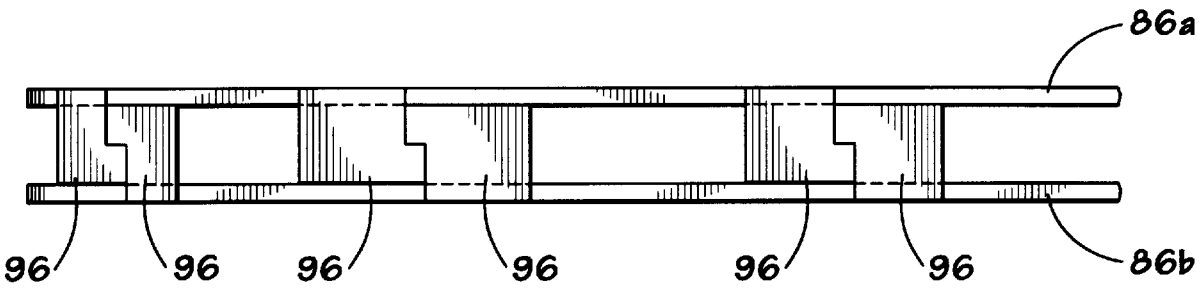
FIG. 17 is a partial bottom view illustrating the lower handle assembly of an embodiment of the present invention.

FIG. 17 is a partial bottom view, illustrating the right and left side lower handle portions 86*a*, 86*b* in their assembled configuration. When placed in their respective, opposing positions, the locking tabs 96 on the right side lower handle portion 86*a* are mirror images of the locking tabs 96 on the left side lower handle portion 86*b*. The locking tabs 96 are simply interlocked to couple the right and left side lower handle portions 86*a*, 86*b* together.

Referring to FIG. 2, it may be noted that the novel configuration of the right and left lower handle portions 86*a*, 86*b* and, in particular, the configuration of the nut-receiving slots 94 and the L-shaped locking tabs 96, allow for economical and efficient assembly of the pair of pliers 10. Specifically, to assemble the pliers 10, an adjustment nut 108 is placed in the slot 94 of the left side lower handle potion 86*b*. The adjustment screw 30 is then threaded through the adjustment nut 108. Alternatively, the adjustment screw 30 may be threaded through the adjustment nut 108 prior to the nut 108 being positioned within the slot 94.

Figure 18:
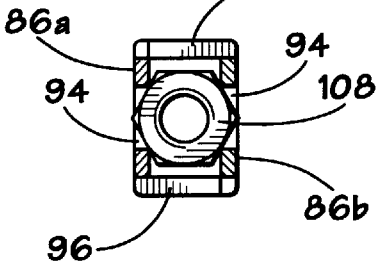
FIG. 18 illustrates an adjustment nut as it is fixed in place by the components of the lower handle assembly in an embodiment of the present invention.

Once the adjustment nut 108 and the adjustment screw 30 are positioned within the slot 94 of the left side lower handle portion 86*b*, the right side lower handle portion 86*a* is positioned such that its slot 94 surrounds the adjustment nut 108. The right side lower handle portion 86*a* is then "snapped" into place such that its L-shaped locking tabs 96 engage the locking tabs 96 of the left side lower handle portion 86*b*. FIG. 18 generally illustrates the manner in which the adjustment nut 108 is held in place by the inter-locked nature of the right and left side lower handle portions 86*a*, 86*b*. The use of the inter-locking locking tabs 96 in the illustrated embodiment of the present invention allows for efficient construction of the locking pliers 10 without time-consuming and costly brazing or welding techniques.

Referring back to FIG. 2, the adjustment screw 30 and the adjustment nut 108 are positioned and held in the cavity formed by the lower handle assembly 22 in the manner discussed above. The adjustment screw 30 is coupled to a connecting arm 110 by an adjustment bracket 112. Exemplary embodiments connecting arm 110, the adjustment bracket 112, and the adjustment screw 30 are illustrated in greater detail in FIGS. 19–21, respectively.

Figure 21:
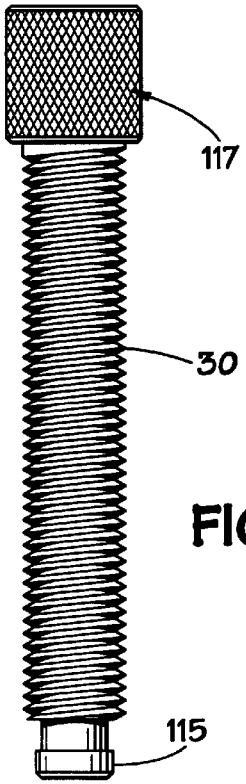
FIG. 21 is a side view illustrating an exemplary adjustment screw in accordance with an embodiment of the present invention.

In general, the adjustment bracket 112 is coupled to the adjustment screw 30 via a slot 113 formed in the adjustment bracket 112 and a pin 115 formed in the adjustment screw 30. As illustrated in FIG. 21, the adjustment screw 30 defines a pin member 115 that may be received in the slot 113 of the adjustment bracket 112. The exemplary adjustment screw 30 also defines a knurled end 117 that projects from the lower handle 22 for use in adjusting the locked and closed position of the locking pliers 10. In one embodiment, only the end of adjustment screw 30 near the pin 115 is hardened.

Figure 19:
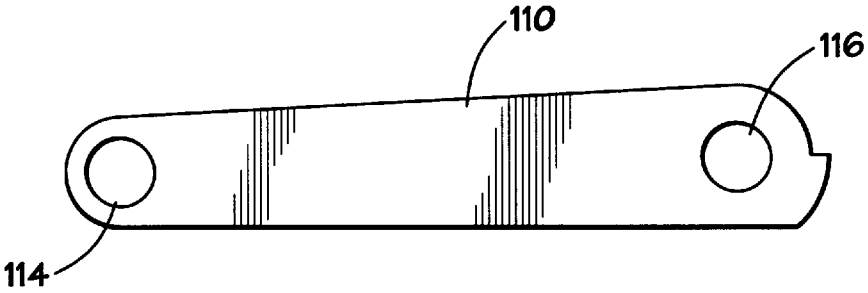
FIG. 19 is a side view illustrating a locking arm in accordance with an embodiment of the present invention.

Referring back to FIG. 2, the adjustment bracket 112 may be coupled to the connection arm 110 via a rivet pin 111. The rivet pin 111 may extend through the adjustment bracket 112 and into the slots 98 of the right and left lower handle portions 86*a* and 86*b*. Referring to FIG. 19, the connection arm 110 has a first end that defines a first bore 114 for receiving the rivet pin 111 for coupling the connection arm 110 to the adjustment bracket 112. The connection arm 110 also has a second end defining a second bore 116 for receiving a rivet pin 115 for connecting the connection arm 110 to the upper handle assembly 12. The second end of the connection arm 110 also defines a locking extension 118 that is shaped to be received by the locking ledge 64 of the pivot release lever 212 of the release mechanism 21. The second end of the connection arm 110 is coupled to the upper handle assembly 12 by the pin 115 that passes through the bore 116 of the connection arm 110 and the bores 46*b* of the right and left upper handle portions 34*a* and 34*b*.

Figure 22:
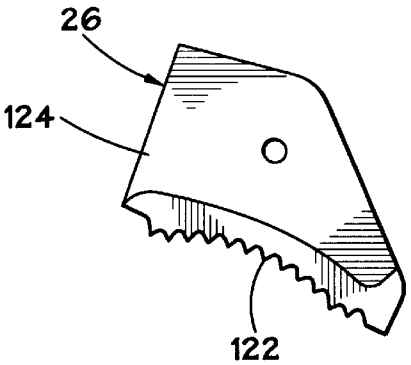
FIG. 22 is a side view illustrating an upper jaw component in accordance with an embodiment of the present invention.

As illustrated in FIG. 2, the lower handle assembly 14 defines a head portion 24 within which is positioned the upper jaw element 26. In general, the right and left side lower handle portions 86*a* and 86*b* form an upper jaw cradle that receives the upper jaw element 26 in a manner similar to the manner in which the lower jaw cradle receives the lower jaw element 27. Specifically, as illustrated in FIG. 22, the upper jaw element 26 includes a toothed jaw surface 122 and an upper extension portion 124. In the illustrated embodiment, upper extension portion 124 is sized to fit within the upper jaw cradle, and the toothed jaw surface 122 is of a width that is greater than the width of the upper jaw cradle, such that the upper extension surface 124 may be placed within the upper jaw cradle with the projecting head portions 92 of the right and left lower handle portions 86*a*, 86*b* supporting the upper jaw element 26. The upper jaw element 26 may be formed in the same manner previously described in connection with the lower jaw element 27.

Figure 23:
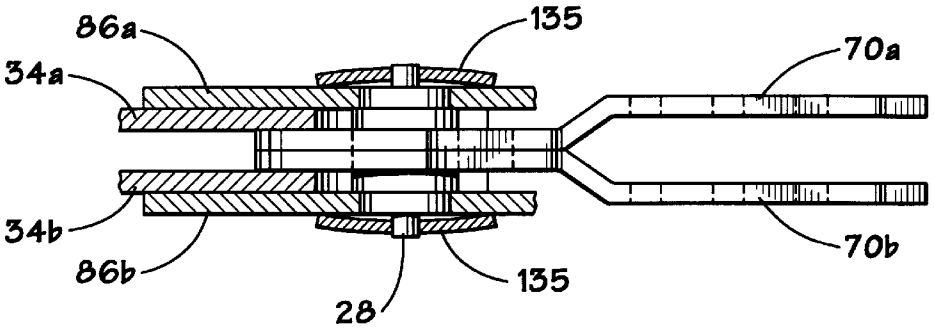
FIG. 23 is a bottom view illustrating an example of the laminate stack formed by various components of an embodiment of the present invention.
Figure 24B:
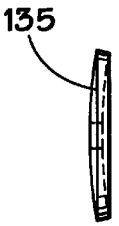
FIGS. 24A and 24B are front and side views of a pivot washer in accordance with an embodiment of the present invention.
Figure 24A:
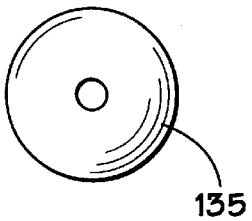

When the pair of pliers 10 is assembled, the upper and lower handle assemblies 12 and 14 are positioned with respect to one another such that a laminate stack is formed. The general nature of the laminate stack formed when the pair of pliers is assembled is illustrated in FIG. 23. In the example of FIG. 23, a stainless steel pivot washer 135 is provided at each end of the laminate stack. An exemplary construction for such pivot washers is provided in FIGS. 24A and 24B.

Figure 25:
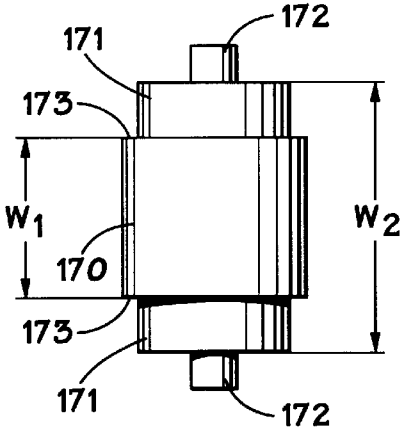
FIG. 25 is a side view illustrating an anti-impingement pin in accordance with an embodiment of the present invention.

The laminate stack is held together, in general, by a novel anti-impingement pin 28. In general, the anti-impingement pin 28 defines two extension members 172 that extend out from the laminate stack. To assemble the pliers, the laminate stack is formed and the extension members 172 are peened over. A detailed illustration of an exemplary anti-impingement pin 28 is provided in FIG. 25. The anti-impingement pin 28 comprises a pin having a center portion 170 and an outer portions 171. The center portion 170 has a width W1, and the center portion 170 together with outer portions 171 have a second width W2. Further, center portion 170 further has a first diameter, and outer portions 171 each have a diameter less than the diameter of center portion 170, whereby a shoulder 173 is formed on either end of the center portion 170. The width W1 is selected such that the width W1 is slightly greater than the width of the laminate stack formed by the upper handle assembly 12 and the lower jaw assembly 16. Because of this precise machining of with W1, the anti-impingement pin 28 will ensure some clearance between the laminate stack including the upper handle assembly 12 (right and left upper handle portions 86*a* and 86*b*) and lower jaw assembly 16. As such, the anti-impingement pin 28 ensures efficient and proper assembly of the pair of pliers 10. Further, the anti-impingement pin 28 of the invention simplifies the riveting process, eliminating the need to stretch the rivet for clearance. It also enhances tool durability, eliminating unpredictable wear.

In the embodiment illustrated in FIG. 2, a biasing spring 150 is situated between the upper and lower handle assemblies 12, 14 to bias the handles 18, 22 of the pliers 10 apart. A middle portion of the biasing spring 150 is coiled around a pin 152 that extends through the pin-receiving bores 47 through the right and left side upper handle portions 34*a*, 34*b*. As shown in FIG. 2, a first outer portion of the biasing spring 150 is seated against the locking tabs 96 of the right and left side lower handle portions 86*a*, 86*b*, and a second portion of the biasing spring is seated against the upper handle spacer 36 of the upper handle assembly 12.

The general operation of the novel locking pliers 10 of the present invention will now be described. The user selects a preferred distance between the upper and lower jaws 26, 27 and presets the jaws 26, 27 through proper adjustment of the adjustment screw 30. The release slide spring 69 is heavier than the pivot release spring 68, and the release pin 222 functions as a securing member. Therefore, if the release slide 214 is not positioned such that the release pin 222 is engaged in the notch 236 (as illustrated in FIG. 2), the release slide spring 69 biases the release slide 214 to a first setting, back (towards the handles 18, 22), and against the pivot release member 212. This prevents the locking extension 118 of the connecting arm 110 from engaging and "locking" into the locking ledge 64 of the pivot release member 212. Therefore, the jaws 26, 27 will not lock during use; in other words, the lower jaw 27 is freely movable relative to the upper jaw 27. Thus, the pliers 10 operates as a spring loaded pliers. This is particularly useful, for example, if the user desires to repeatedly open and close the jaws 26, 27 to "ratchet" the pliers 10 about a work piece.

Figure 26A:
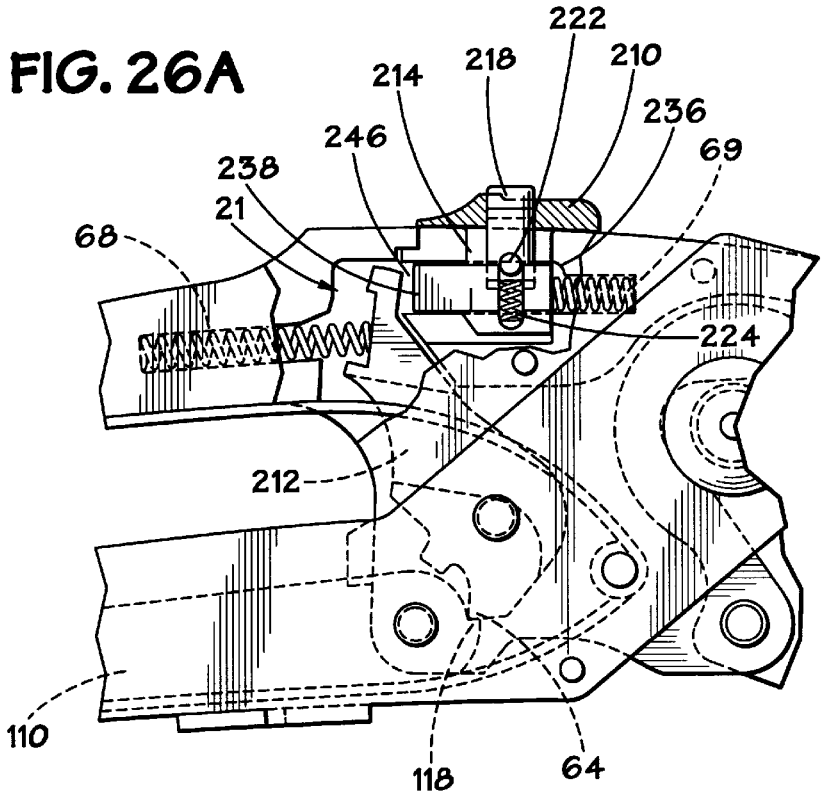
FIGS. 26A–26C are partial side views illustrating the operation of the release mechanism in an embodiment of the present invention.
Figure 26B:
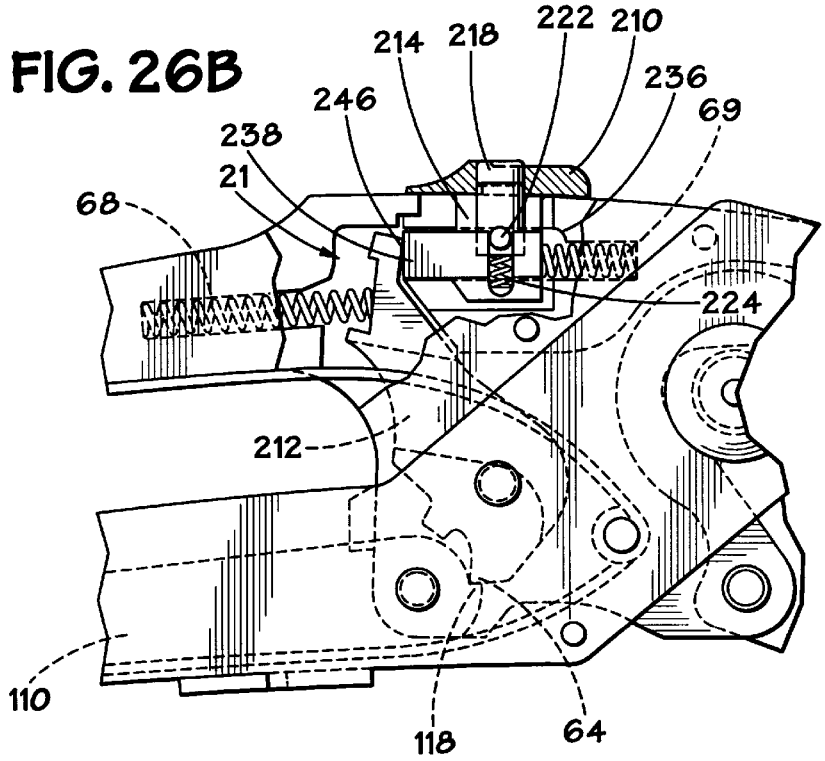
Figure 26C:
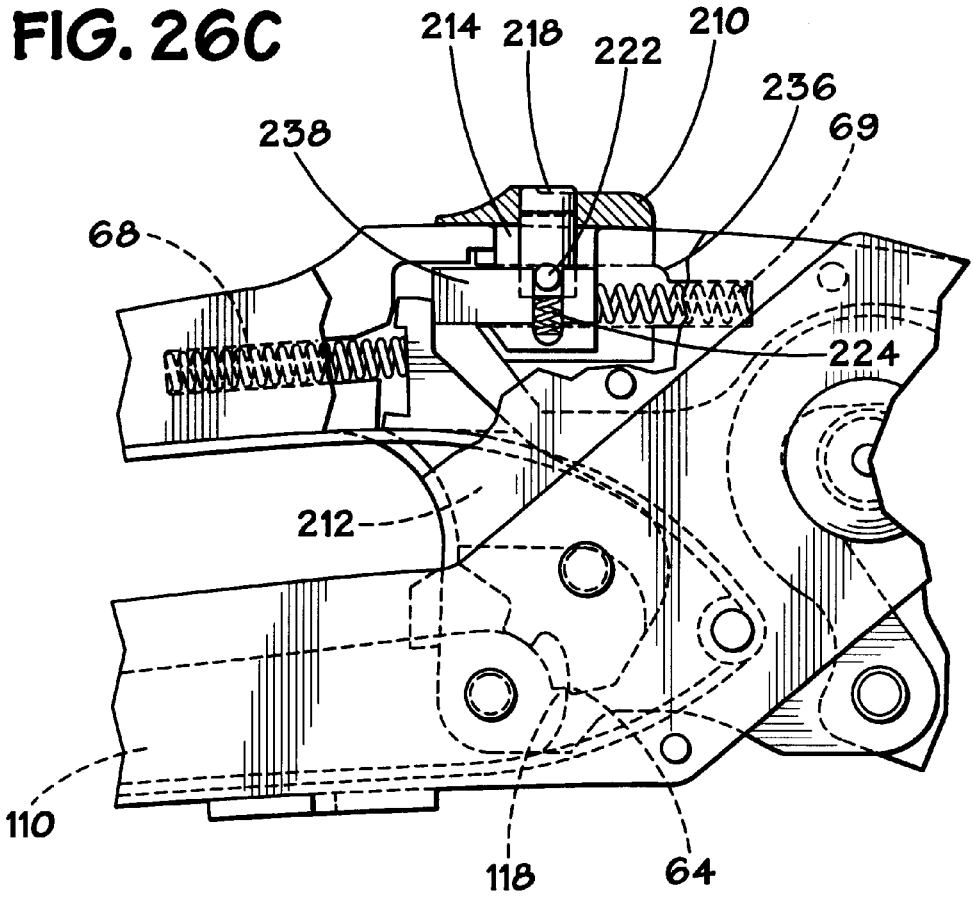

FIGS. 26A–26C show partial side views of the pliers 10, illustrating the positions of the various components of the release mechanism 21 when the pliers 10 is in locked and unlocked positions. To lock the jaws 26, 27 about a work piece, the user first slides the actuator 210 of the release slide 214 forward (towards the jaws 26, 27) to a second setting, compressing the release slide spring 69. When the release pin 222 extending from the release button 218 reaches the notch 236, the release spring 224 will push the release button 218 up, and the release pin 222 will engage the notch 236, as shown in FIG. 26A. This locks the release mechanism in the second setting, preventing the release slide 214 from moving laterally within the cavity formed by the upper handle portions 34*a*, 34*b* and the outer and middle release spacers 230, 232. Hence, when the release pin 222 is engaged in the notch 236, the release slide 214 cannot engage the pivot release member 212.

The user then brings the upper and lower handles 18, 22 together until the locking extension 118 of the connecting arm 110 is received in and "locks" into the locking ledge 64 of the pivot release member 212. Now, the lower jaw 27 is locked at the distance preset by operation of the adjusting screw 30. Referring to FIG. 23A, once the locking extension 118 is received in the locking ledge 64, a gap 246 is formed between the lower portion 238 of the pivot release member 212 and the release slide 214, and the pivot release spring 68 biases the pivot release member 212 so as to prevent the locking ledge 64 from disengaging the locking extension 118 of the connecting arm. Thus, the pliers 10 will remain in their closed and locked position even as the user manipulates the handles 18,22.

Referring now to FIGS. 26B and 26C, the actions required to release the pliers 10 from the closed and locked position will be described. First, the user pushes the release button 218 to disengage the release pin 222 from the notch 236. As noted above, the release slide spring 69 is heavier than the pivot release spring 68, so the release slide spring 69 pushes the release slide 214 back (towards the handles 18, 22) to a third setting. This movement of the release slide closes the gap 246 between the lower portion 238 of the release slide 214 and the pivot release member 212, and slightly compresses the pivot release spring 68.

To release the jaws 26, 27, the user then squeezes the handles 18, 22 together, thereby disengaging the locking ledge 64 from the locking extension 118. As illustrated in FIG. 26C, the release slide spring 69 fully extends, pushing the pivot release member 212 against the pivot release spring 68 and, in turn, pushing the locking ledge 64 away from the locking extension 118 to prevent the pliers 10 from unintentionally locking. Since the release slide spring 69 is heavier than the pivot release spring 68, the release slide 214 remains biased back (towards the handles 18, 22) to the first setting. For this reason, the pliers 10 will not lock, until the release slide 214 is moved to the forward position.

The present invention is not limited to the specific embodiments of the release mechanism described above. For example, it would be a routine undertaking for one skilled in the art having the benefit of this disclosure to vary the configuration of the release button 218 such that it locks the release slide at a setting other than the second setting, wherein the jaws 26, 27 will lock. Further the biasing springs 68, 69 could be reconfigured to normally bias the release mechanism to a setting other than the first setting described above, wherein the jaws 26, 27 will not lock.

As may be noted from the preceding, the connection arm 110 of the pliers 10 of the present invention remains, during the operation of the pliers, essentially within the cavity defined by the lower handle assembly 14. Moreover, there are no projections from the connection arm 110 that extend out from the cavity defined by the lower handle assembly 14. This is in contrast to prior art locking pliers that typically include a link member that extends across the handles or that had an "extension bump" that would be contacted by another member to unlock the pliers. In the illustrated embodiment of the present invention, the connection arm 110 does not require such an "extension bump" since the locking and unlocking of the pliers is accomplished through the use of the release lever mechanism 21, which has its locking elements positioned within the cavity defined by both the upper and lower handle assemblies 12, 14. This aspect of the present invention is beneficial, among other things, because it reduces the chance that "pinch points" (points where material may be "pinched" between components of the pliers) will be formed.

Figure 27B:
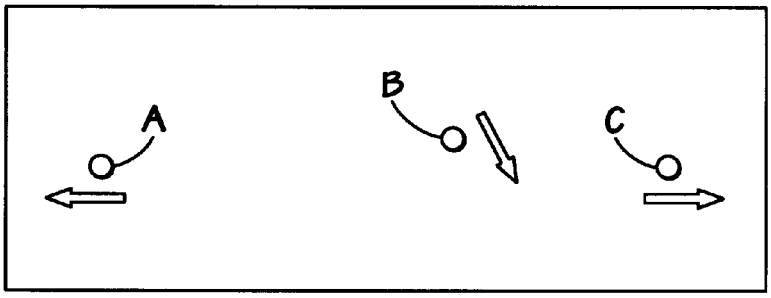
FIG. 27B is a conceptual diagram, illustrating the operation of the anti-past center stop of an embodiment of the present invention.
Figure 27A:
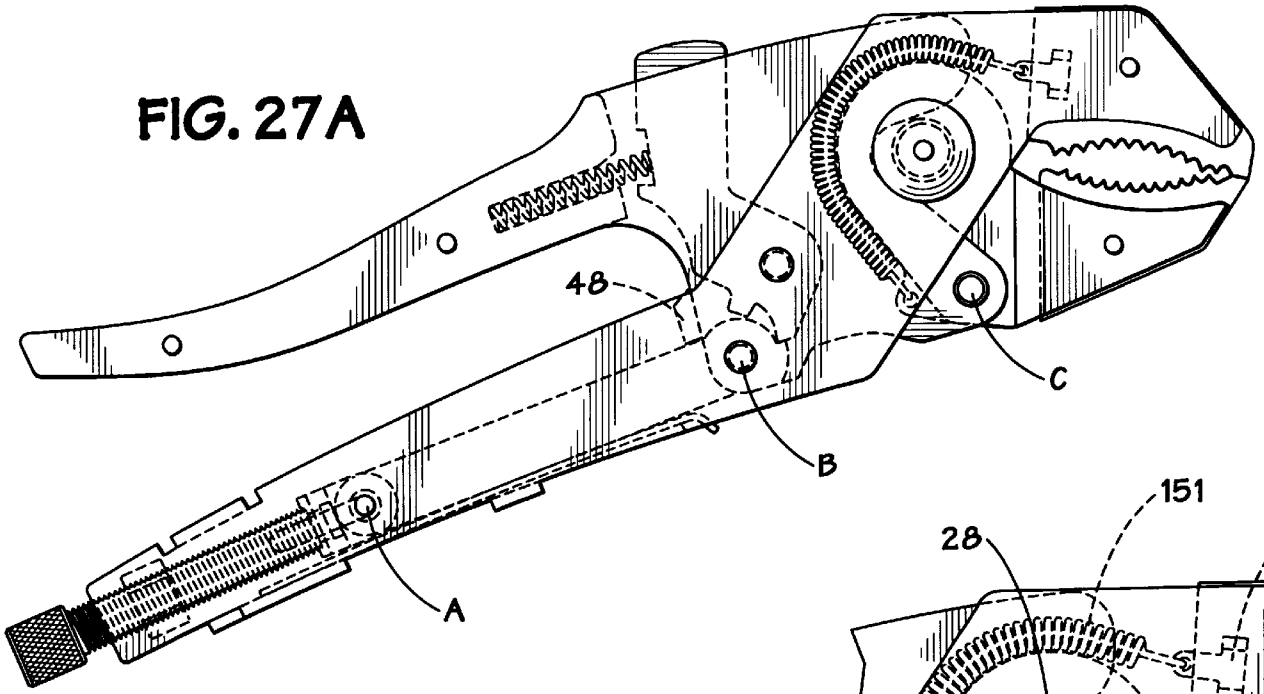
FIG. 27A is a side view.

A further feature of the pliers 10 of the present invention concerns the inclusion of an anti-past center stop 48 that prevents the positioning of the pliers in an inappropriate position. FIG. 27A generally reproduces FIG. 2 without certain labels. As illustrated in FIG. 17A, the bent portions 48 of the right and left upper handle portions 34*a* and 34*b* form a stop member 48. This stop member prevents undesirable centering of the pivot points marked A, B and C in FIG. 17A.

From FIG. 27A it will be apparent that, as the adjustment screw 30 is adjusted, the pivot points A, B and C will move with respect to one another. Specifically, as the adjustment screw 30 is adjusted to move the locking portion of the connection arm 110 towards the knurled end 117 of the adjustment screw 30, the pivot release member 212 will tend to move towards the knurled end 117 of the adjustment screw 30 and the pivot pin B will tend to move towards alignment with pivot points A and C. This relative movement is generally illustrated by FIG. 27B. Also, opening and closing the pliers 10 may tend to bring the pivot points A, B and C into alignment.

As those of ordinary skill in the art will appreciate, if the pivot points A, B and C become aligned, (i.e., if B becomes centered with respect to A and C) there is a possibility that, upon the application of force, the pivot point B will not return to its original and desired position—above A and C in the example, but will tend to move towards an undesirable position (e.g., below A and C in the example). To avoid this undesirable possibility, the present invention provides the anti-past center stop 48 that serves as a "stop" to prevent adjustment or movement of the pliers to the point where pivot point B is centered with respect to pivot points A and C. Specifically, the anti-past center stop 48 will contact the pivot release member 212 and prevent the release arm from moving to a position where B is centered with respect to A and C.

The laminate stack configuration of the pliers 10 allows for a novel "stack" manufacturing process, which provides a simple assembly process requiring minimal tools and sub-assembly processes. The components are essentially stacked one upon another to assemble the locking pliers 10. An example of the stack assembly process for the locking pliers 10 as is illustrated in FIG. 2 follows below.

Beginning with the left side lower handle 86*b*, one of the outer portions 171 of the anti-impingement pin 28 extends through the bore 100 such that the shoulder 173 seats against the left side lower handle 86*b*. Extension members 172 extend through the bore 100 and extend out from the left side lower handle 86*b*. The pivot washer 135 fits over the extension member 172, which is peened over to lock the anti-impingement pin 28 in place.

The left side upper handle 34*b* is stacked on the left side lower handle 86*b* such that the cut-out section 50 seats against the anti-impingement pin 28. The lower jaw assembly 16 is stacked on top of the left side upper handle 34*b* such that component 70*b* lies adjacent the left side lower handle 86*b*. Further, the anti-impingement pin 28 center portion 170 extends through the large bore 72 in the lower jaw assembly 16. The upper jaw member 26 is positioned on the head portion 24 of the left side lower handle 86*b*.

The components of the release mechanism 21 are assembled as described above, and along with the pivot release member 212, are also stacked on the left side upper handle 34*b*. The rotation pin 66 extends through the bore 60 of the pivot release member 212 and the bore 46*a* of the left side upper handle 34*b* so that one end of a pin 66 terminates in the bore 46*a* and the pivot release member 212 pivots about the pin 66. The combination of the adjustment screw 30 coupled to the connecting arm 110 by the adjustment bracket 112 is stacked onto the left side upper handle 34*b*, and the rivet pin 111 extends through the adjustment bracket 112 and into the slot 98 in the left side upper handle 34*b*. The adjustment nut 108 is placed about the adjustment screw 30 and received by the slot 94.

The upper handle spacer 36 is stacked on the handle portion 40 of the left upper handle 34*b*. The pivot release spring 68 and the release slide spring 69 are positioned within their respective slots 54, 234. The pin 152 is positioned in the pin-receiving bore 47 extending through the left upper handle 34*b*, and the biasing spring 150 and the outer portions of the biasing spring 150 are seated against the locking tabs 96 of the left side lower handle portion 86*b* and the upper handle spacer 36. The right upper handle 34*a* is stacked on the assembly next, with the cut-out 50 seating against the anti-impingement pin 28, and pins are passed through bores 46*a*, 46*b* and 46*c*. Finally, the right lower handle 86*a* is stacked on the right upper handle 34*a*. The locking tabs 96 interlink to hold the handle portions 86*a* and 86*b* together. The anti-impingement pin 28 outer portion 171 extends through the bore 100 such that the shoulder 173 seats against the right side lower handle 86*a*, and a pivot washer 135 fits over the anti-impingement pin 28 and the extension 172 is peened. The various rivets are then put in place to secure the laminate structure together.

The novel laminate construction of the locking pliers 10 further allows for a simple and economic progressive stamping process for fabricating several of the components discussed and described herein, requiring a minimal number of die patterns.

Figure 28:
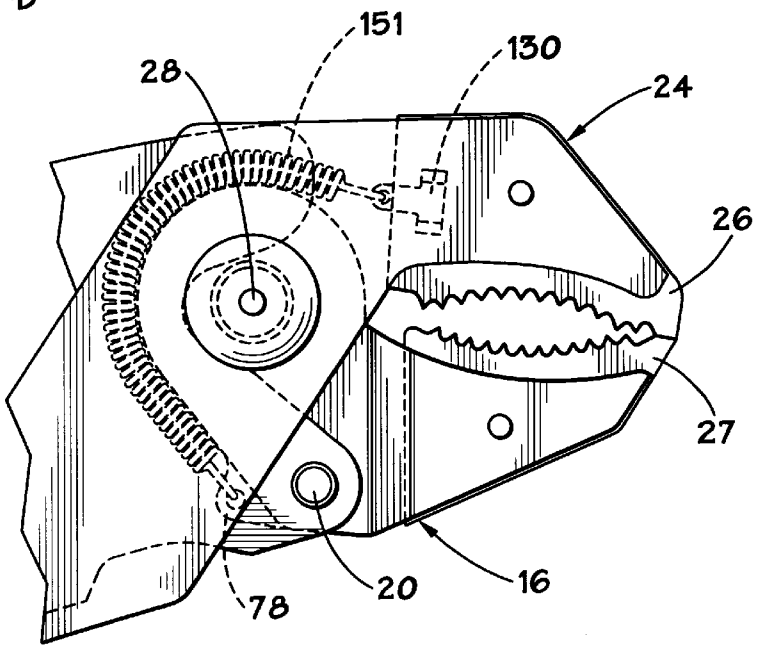
FIG. 28 is a partial side view illustrating an alternative embodiment of the present invention, in which the main biasing spring comprises an extension spring.

In the embodiment disclosed in conjunction with FIG. 2, the biasing spring 150 comprises a coil spring. FIG. 28 illustrates a portion of an alternative embodiment of the pliers 10, in which the biasing spring comprises an extension spring 151 that has one end coupled to the upper jaw and the other end coupled to the lower jaw. The extension spring 151 serves to bring the pliers 10 to an open position when the pair of pliers 10 is released from its closed and locked position. The extension spring 151 also tends to retain the upper and lower jaw elements 26, 27 in a parallel or near-parallel relationship to allow for a better gripping angle. In such an embodiment, the upper and lower jaw elements include a suitable connector to which the spring connects.

Figure 30A:
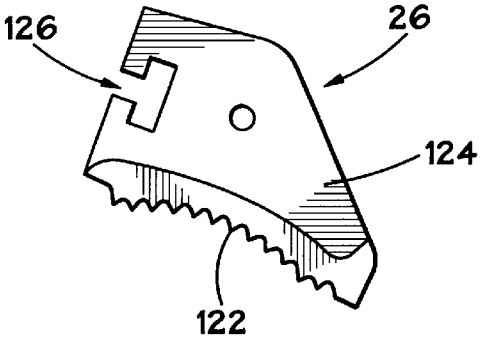
FIGS. 30A and 30B are side views illustrating exemplary components of an upper jaw element suitable for use with the embodiment of the present invention illustrated in FIG. 28.
Figure 30B:
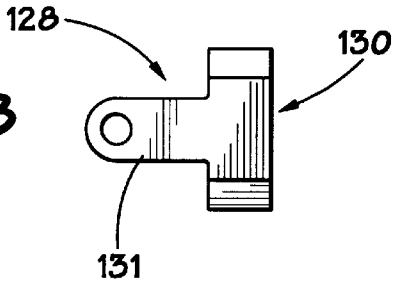
Figure 29:
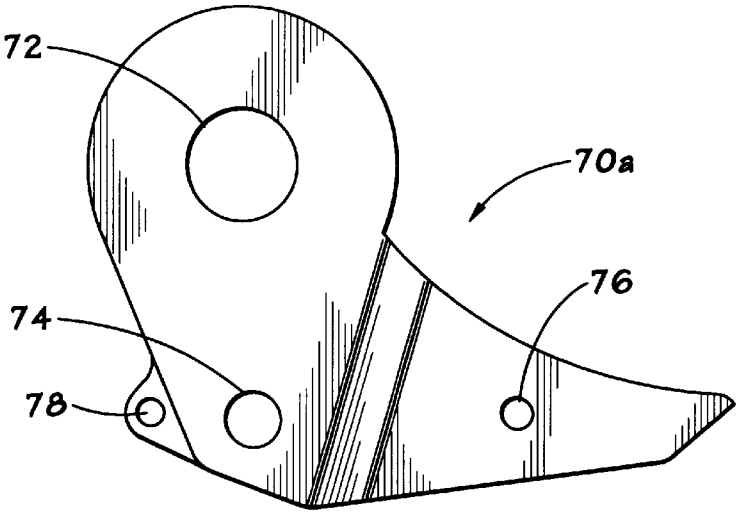
FIG. 29 is a side view illustrating an exemplary lower jaw support suitable for use with the embodiment of the present invention illustrated in FIG. 28.

Examples of suitable connectors are illustrated in FIGS. 29 and 30. In one exemplary embodiment illustrated in FIG. 29, the components 70*a* of the lower jaw is assembly 16 defines a spring connection extension 78 that extends from the component 70*a*. In FIG. 30A, an exemplary upper jaw element 26 defines a generally T-shaped slot 126. This generally T-shaped slot is designed to receive a generally T-shaped upper jaw insert 128 of the type illustrated in FIG. 30B. The T-shaped upper jaw insert 128 includes a head portion 130 and a spring connection portion 131. The extension spring 151 has one end coupled to the spring connection portion 131 of the T-shaped upper jaw insert 128 and a second end coupled to the spring connection extension 78 of lower jaw assembly 16. In yet another embodiment, rather than providing a T-shaped slot and separate jaw insert 128, the upper jaw element 26 simply includes a spring connector extending from the upper extension surface 124, proximate the T-shaped slot of the jaw element 26 illustrated in FIG. 30A.

Figure 31A:
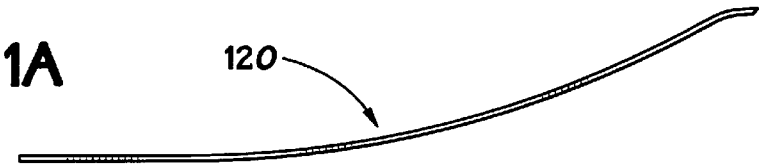
FIGS. 31A and 31B are side and bottom views of an exemplary leaf spring suitable for use in the lower handle assembly of an embodiment of the present invention.
Figure 31B:
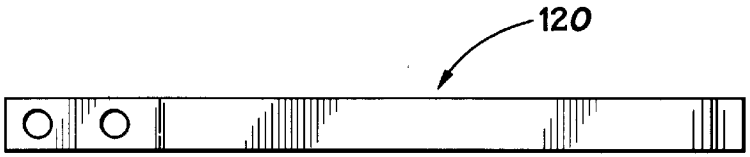

In yet another embodiment, a leaf spring 120, such as that illustrated in FIGS. 31A and 31B, provides a biasing force tending to bias the connection arm 110 upwards (towards the upper handle assembly 12). The leaf spring 120 may be formed from spring steel and may be coupled via rivets to one, or both, of the right and left side lower handle portion 86*a*, 86*b*. In addition to tending to bias the connection arm 110 to a bias position, the leaf spring 120 also tends to maintain the pliers 10 in their closed and locked position when the pliers are placed in their closed and locked position because the leaf spring 120 will tend to bias the connecting arm 110 such that it remains in a "locked" relationship with the locking portion of the pivot release member 212. Further, when the release lever 21 is depressed and the connection arm 110 is disengaged from the release lever 21, the spring 120 will tend to force the pliers to their open position. The use of such a leaf spring 120 does not require any modification of connection arm 110 to accommodate the existence of the leaf spring 120 within the cavity defined by the lower handle assembly 14. The leaf spring 120 may simply be riveted to one of the L-shaped locking tabs 96.

Figure 32:
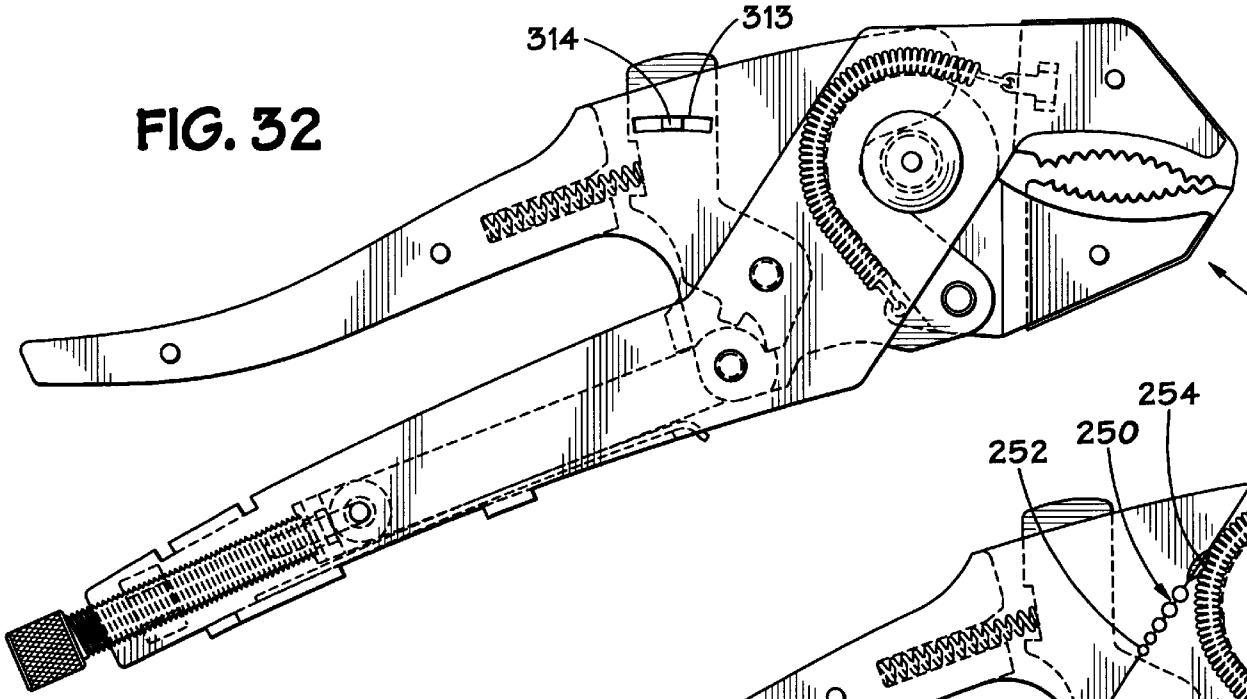
FIG. 32 is a side view illustrating an alternate embodiment of a release actuator in accordance with the present invention.
Figure 33:
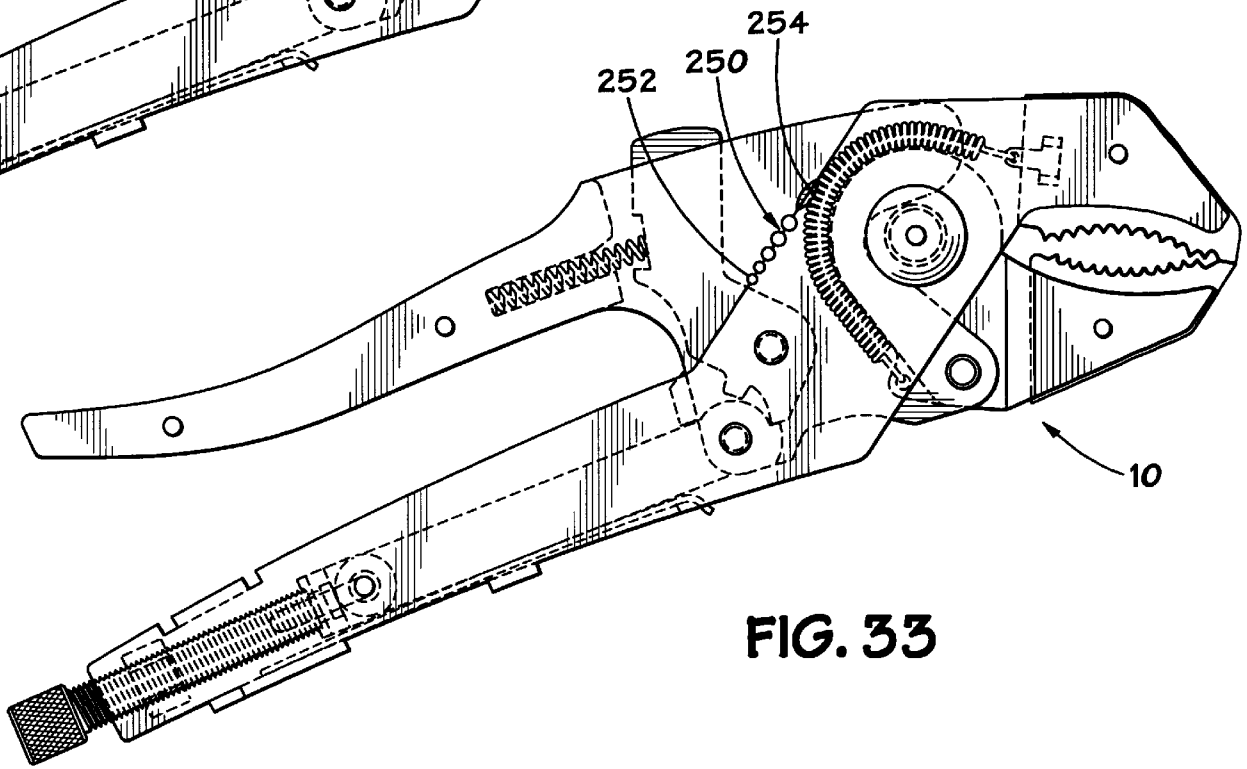
FIG. 33 is a side view illustrating a locking pliers in accordance with an alternate embodiment of the present invention, including wire strippers and a wire cutter.

Further, the configurations of the upper and lower jaw elements 26 and 27 may be different from those illustrated above. In particular, V-notched, straight and curved jaw configurations are envisioned. Still further, in the illustrative embodiment described above, the actuator 210 of the release mechanism 21 extends from the top of the upper handle assembly 12. Likewise, in the embodiment described above employing the pivot release member 213 illustrated in FIG. 10, the top portion of the release member 213 extends from the top of the upper handle assembly 12. Other embodiments, such as the one illustrated in FIG. 32, are envisioned wherein the upper handle portion 12 includes side slots 313 and a lever 314 or other suitable mechanism extends sidewise from the upper handle assembly such that the side lever may be activated to unlock the pliers 10. In such an embodiment, the side lever may be adjustable for left-handed or right-handed operation. In such an embodiment the top portion of the release lever 213 may be eliminated entirely or retained.

Figure 20B:
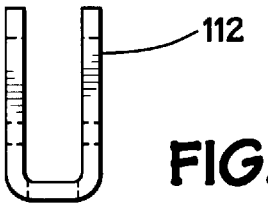
FIGS. 20A and 20B illustrate side and front views of an adjustment bracket in accordance with an embodiment of the present invention.
Figure 20A:
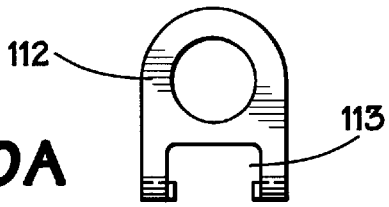

A still further embodiment involves the construction of the upper handle assembly 12. As discussed above, the upper handle assembly 12 is sized such that, as the pliers 10 are opened and closed, there is little or no gap created between the upper handle assembly 12 and the lower handle assembly 14. Alternative embodiments are envisioned where such a gap is intentionally introduced and is controlled to form wire cutters and/or wire strippers. Such an alternate embodiment is generally illustrated in FIG. 20 where the upper handle assembly is sized such that a controlled gap 250 can be established through proper adjustment of the adjustment screw 30. In the illustrative embodiment the gap 250 defines several wire strippers 252 of several sizes and a wire cutter 254.

While the invention has been described in connection with the illustrative embodiments discussed above, those skilled in the art will recognized that many variations may be made without departing from the present invention. For example, the components of the locking pliers disclosed herein may be formed from different materials than described herein. Accordingly, the above description of several embodiments is made by way of example and not for purposes of limitation. The present invention is intended to be limited only by the spirit and scope of the following claims.

What is claimed is:

1. A pair of locking pliers comprising:

a first assembly defining a first handle and a first jaw, the first handle defining a cavity therein;

a second handle;

a second jaw pivotably coupled to the first assembly and the second handle, such that the second handle is movable relative to the first handle to move the second jaw relative to the first jaw;

a locking mechanism interconnecting the first assembly and the second handle, the locking mechanism including a locking arm defining a locking extension, the locking arm and locking extension being situated within the cavity of the first handle; and a release mechanism pivotably coupled to the second handle, the release member defining a locking ledge formed for selective engagement with the locking extension of the locking arm for locking the second jaw at a predetermined distance from the first jaw.

2. The locking pliers of claim 1 wherein the first jaw is fixed relative to the first handle.

3. The locking pliers of claim 1 wherein the locking mechanism includes an adjustment mechanism for setting the distance between the second jaw and the first jaw when the locking extension of the locking arm is engaged with the locking ledge of the release mechanism.

4. The locking pliers of claim 3 wherein the adjustment mechanism comprises:

an adjustment screw having a first end connected to the locking arm; and a nut fixed within the cavity, the adjustment screw threadably engaged in the nut such that turning the adjustment screw moves the locking arm laterally within the cavity.

5. The locking pliers of claim 4 wherein the first assembly includes two walls defining two sides of the cavity, each of the walls defining an opening extending therethrough, each of the openings adapted to receive a portion of the nut, such that the nut is held within the openings to fix the nut within the cavity.

6. The locking pliers of claim 4 wherein the locking arm defines first and second ends, and wherein:

the second handle is connected to the second jaw at a first pivot point;

the first end of the locking arm is connected to the second handle at a second pivot point;

the first end of the adjustment screw is connected to the second end of the locking arm at a third pivot point; and the second handle includes a stop adapted to prevent the first, second and third pivot points from aligning.

7. The locking pliers of claim 1 wherein the release mechanism comprises a release lever having first and second ends, the first end defining the locking ledge, the second end movable to pivot the release lever to one of a first position wherein the locking ledge engages the locking extension of the locking arm when the second handle is moved towards the first handle, and a second position wherein the locking ledge disengages the locking extension of the locking arm.

8. The locking pliers of claim 6 wherein the release mechanism further comprises an actuator movably mounted to the second handle, the actuator interacting with the second end of the release lever to pivot the release lever to one of the first and second positions.

9. The locking pliers of claim 8 wherein the second handle defines a cavity therein, and wherein the release lever is situated within the cavity in the second handle.

10. The locking pliers of claim 1 further comprising an anti-impingement pin including a generally cylindrical center portion defining a first diameter and a width, two generally cylindrical outer portions extending coaxially from either side of the center portion, the outer portions each defining a second diameter that is less than the first diameter, and two extension members extending coaxially from either outer portion; wherein:

the first assembly, the second handle and the second jaw are each of a laminated construction, each comprising two substantially flat pieces, each piece defining a width;

the second jaw pieces being situated adjacent each other and defining a bore extending therethrough, the bore adapted to receive the center portion of the anti-impingement pin such that the second jaw pivots about the center portion;

the second handle pieces being situated on either side of the second jaw pieces;

the first assembly pieces each defining a bore extending therethrough, each bore adapted to receive one of the outer portions of the anti-impingement pins such that the first assembly pivots about the outer portions;

the width of the center portion of the anti-impingement pin being greater than the sum of the widths of the second jaw and second handle pieces; and each of the extension members has a securing member affixed thereto.

11. The locking pliers of claim 1 further comprising a biasing member adapted to normally bias the second handle away from the first handle.

12. The locking pliers of claim 11 wherein the biasing member comprises a coil spring having first and second ends and an intermediate portion between the first and second ends, the first end coupled to the first handle, the second end coupled to the second handle, the intermediate portion coiled around a pin fixed to the first assembly, wherein the coil spring biases the second handle apart from the first handle.

13. The locking pliers of claim 11 wherein the biasing member comprises an extension spring coupled between the first and second jaws so as to pull the jaws apart.

14. A pair of locking pliers comprising:

a first assembly defining a first handle and a first jaw;

a second handle;

a second jaw pivotably coupled to the first assembly and the second handle, such that the second handle is movable relative to the first handle to move the second jaw relative to the first jaw;

a release mechanism having a first setting wherein the second jaw is freely movable relative to the first jaw, a second setting wherein the second jaw locks at a preset distance from the first jaw when the second handle is moved toward the first handle, and a third setting wherein the second jaw unlocks when the second handle is moved toward the first handle; and a biasing member adapted to normally bias the release mechanism to the first setting.

15. The locking pliers of claim 14 wherein the release mechanism further includes a securing device adapted to selectively lock the release mechanism in the second setting.

16. The locking pliers of claim 14 further comprising a locking arm defining a locking extension, and wherein the release mechanism comprises:

a pivot member rotatably coupled to the second handle, the pivot member having first and second ends, the first end defining a locking ledge adapted to engage the locking extension to lock the second jaw relative to the first jaw; and a release slide movably mounted to the first assembly, the release slide situated to interact with the second end of the pivot member to selectively engage and disengage the locking ledge and locking extension.

17. The locking pliers of claim 16 wherein the second handle defines a notch, and wherein the release slide defines an opening therein adapted to receive a release button, the release button including a pin extending therefrom adapted to seat within the notch to lock the release slide in a predetermined position.

18. The locking pliers of claim 16 wherein the second handle defines a cavity therein, and wherein the pivot member and at least a portion of the release slide are positioned within the cavity.

19. A pair of locking pliers comprising:

an upper handle assembly, the upper handle assembly defining an upper handle and an upper handle cavity;

a release lever pivotably mounted in the upper handle cavity, the release lever defining a locking ledge;

a lower handle assembly, the lower handle assembly defining a lower handle, a lower handle assembly cavity, and an upper head portion;

an upper jaw element positioned within the upper head portion;

a lower jaw assembly including a lower jaw element, the lower jaw assembly being pivotably coupled to the upper handle assembly; and an adjustment mechanism positioned within the lower handle assembly cavity, the adjustment mechanism being coupled to the upper handle assembly and including a connection arm defining a locking end that is formed for selective engagement with the locking ledge of the release lever, wherein adjustment of the adjustment assembly adjusts the distance between the upper jaw element and the lower jaw element when the locking end of the connection arm is engaged with the locking ledge of the release lever.

20. The locking pliers of claim 19 wherein the upper handle assembly, the lower handle assembly, and a lower jaw assembly are formed from substantially flat components, the flat components stacked together to form a laminate stack.

21. A pair of locking pliers comprising:

a first handle defining a handle portion and a jaw portion;

a second handle;

a second jaw pivotably coupled to the second handle such that the second handle is movable relative to the first handle portion first means for pivotably coupling the second jaw to the first handle; and second means for locking and releasing the first and second jaws relative to each other, including means for selectively setting the second means at a first setting wherein the second jaw is freely movable relative to the first jaw, a second setting wherein the second jaw locks at a preset distance from the first jaw when the second handle is moved toward the first handle, and a third setting wherein the second jaw unlocks when the second handle is moved toward the first handle.

22. The locking pliers of claim 21 further comprising third means for presetting the second jaw at a desired distance from the first jaw when the jaws are locked.

23. The locking pliers of claim 21 wherein the second means includes means for selectively setting the second means at a first setting wherein the second jaw is freely movable relative to the first jaw, a second setting wherein the second jaw locks at a preset distance from the first jaw when the second handle is moved toward the first handle, and a third setting wherein the second jaw unlocks when the second handle is moved toward the first handle.

24. The locking pliers of claim 21 further comprising means for biasing the first and second handles normally apart.

25. A pair of locking pliers comprising:

a first assembly defining a first handle and a first jaw;

a second handle;

a second jaw pivotably coupled to the first assembly and the second handle, such that the second handle is movable relative to the first handle to move the second jaw relative to the first jaw;

a locking arm defining a locking extension; and a release mechanism including:

a pivot member pivotably coupled to the second handle, the pivot member having first and second ends, the first end defining a locking ledge adapted to engage the locking extension to lock the second jaw relative to the first jaw; and a release slide movably mounted to the first assembly, the release slide situated to interact with the second end of the pivot member to selectively engage and disengage the locking ledge and locking extension;

wherein the release mechanism has a first setting wherein the second jaw is freely movable relative to the first jaw, a second setting wherein the second jaw locks at a preset distance from the first jaw when the second handle is moved toward the first handle, and a third setting wherein the second jaw unlocks when the second handle is moved toward the first handle.

26. A pair of locking pliers comprising:

a first handle defining a handle portion and a jaw portion;

a second handle;

a second jaw pivotably coupled to the second handle such that the second handle is movable relative to the first handle portion first means for pivotably coupling the second jaw to the first handle;

second means for locking and releasing the first and second jaws relative to each other; and third means for biasing the first and second handles normally apart.

* * * * *